US007400845B2

(12) United States Patent
Okoshi

(10) Patent No.: US 7,400,845 B2
(45) Date of Patent: Jul. 15, 2008

(54) PROCESS CARTRIDGE SUPPORTED BY IMAGE FORMING APPARATUS MAIN BODY AND IMAGE FORMING APPARATUS USING THE SAME

(75) Inventor: Takeshi Okoshi, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 306 days.

(21) Appl. No.: 11/229,585

(22) Filed: Sep. 20, 2005

(65) Prior Publication Data

US 2006/0216063 A1 Sep. 28, 2006

(30) Foreign Application Priority Data

Mar. 25, 2005 (JP) ..... P2005-089590

(51) Int. Cl.
*G03G 21/18* (2006.01)

(52) U.S. Cl. ..... 399/113

(58) Field of Classification Search ..... 399/111, 399/112, 113, 119, 120
See application file for complete search history.

(56) References Cited

U.S. PATENT DOCUMENTS

| | | | | |
|---|---|---|---|---|
| 6,002,896 | A * | 12/1999 | Miyamoto et al. | 399/114 |
| 6,549,737 | B2 * | 4/2003 | Sano et al. | 399/111 |
| 6,934,489 | B2 * | 8/2005 | Yokomori et al. | 399/111 |
| 7,035,569 | B2 * | 4/2006 | Park | 399/116 |
| 7,158,736 | B2 * | 1/2007 | Sato et al. | 399/111 |
| 7,260,342 | B2 * | 8/2007 | Nishimura | 399/113 |
| 2003/0161654 | A1 | 8/2003 | Yokomori et al. | |
| 2005/0220485 | A1 | 10/2005 | Yokomori et al. | |

FOREIGN PATENT DOCUMENTS

| | | | |
|---|---|---|---|
| CN | 1431565 | A | 7/2003 |
| JP | 07-146634 | A | 6/1995 |
| JP | 08-305248 | A | 11/1996 |
| JP | 08314256 | A * | 11/1996 |
| JP | 2001242692 | A * | 9/2001 |
| JP | 2003-186291 | A | 7/2003 |
| JP | 2004-037638 | A | 2/2004 |
| JP | 2003-186291 | B2 | 3/2004 |

* cited by examiner

*Primary Examiner*—Robert Beatty
(74) *Attorney, Agent, or Firm*—Sughrue Mion, PLLC

(57) ABSTRACT

A process cartridge provided attachably and detachably to and from an image forming apparatus main body, and including an image carrier, a developing unit for visualizing an electrostatic latent image on the image carrier and a toner replenishing unit for replenishing at least a toner to the developing unit, includes: an image carrier cartridge unitized by including at least the image carrier and positioned and supported by the image forming apparatus main body; and a developing cartridge unitized by including at least the developing unit and urged to press to the image carrier cartridge in a state of being positioned relative to the image carrier cartridge, wherein: the toner replenishing unit is included in at least either of the image carrier cartridge and the developing cartridge; and at least a portion of the toner replenishing unit is supported by the image forming apparatus main body.

15 Claims, 15 Drawing Sheets

PROCESS CARTRIDGE SUPPORTED BY IMAGE FORMING APPARATUS MAIN BODY AND IMAGE FORMING APPARATUS USING THE SAME

BACKGROUND OF THE INVENTION

1. Field of the Invention

The present invention relates to a process cartridge used in an image forming apparatus of an electronic photography copier, a printer or the like, particularly relates to an improvement in a process cartridge of a mode in which a developing cartridge including a developing unit is urged to press to an image carrier cartridge including an image carrier in a state of being positioned thereto and an image forming apparatus using the same.

2. Background Art

In a background art, there is used an image forming apparatus of, for example, an electronic photography system normally arranged with various devices for electronic photography such as a charging unit, a developing unit, a transcribing unit, a cleaning unit at a surrounding of an image carrier of a photosensitive drum or the like and there has already been provided an image forming apparatus in which the various devises having the same service life are summarized to form a process cartridge and when the service life is expired, interchanging operational performance is simplified.

As a process cartridge 500 of this kind, as shown by, for example, FIG. 15, there is normally adopted a system including an image carrier cartridge 501 including an image carrier 511 of a photosensitive drum or the like and a charging unit 512, a cleaning unit 513, and a developing cartridge 502 including a developing unit (including developing function parts of a developing roll and the like) 521 arranged opposedly to the image carrier 511 and a toner replenishing unit 522 for replenishing a toner to the developing unit 521, in which the image carrier cartridge is positioned and fixed by an image forming apparatus main body, relative to the image carrier cartridge 501, the developing cartridge 502 is pivotably positioned to engage with the image carrier cartridge 501 by a pivot shaft (engaging shaft), not illustrated, further, the developing cartridge 502 is urged in a predetermined direction by an urging element of an urge spring or the like, and is urged to press to the image carrier cartridge 501 in a state of positioning the developing cartridge 502 thereto (for example, JP-A-2004-37638 and Japanese Patent No. 3534104).

However, according to the process cartridge described in JP-A-2004-37638 and Japanese Patent No. 3534104, the developing cartridge 502 is constituted by integrating the toner replenishing unit 522 to the developing unit 521 and therefore, when a weight of the toner replenishing unit 522, that is, a toner containing amount is changed, a press urge force of the developing cartridge 502 to the image carrier cartridge 501 is varied and there is a concern of bringing about a disturbance in an image.

That is, in the case of setting the press urge force of the developing cartridge 502 to be proper when a toner containing amount of the toner replenishing unit 522 is full, when the toner containing amount becomes small, the press urge force becomes deficient and there is a concern of separating the developing roll of the developing unit 521 from the image carrier 511.

Conversely, in the case of setting the press urge force of the developing cartridge 502 to be proper when the toner containing amount of the toner replenishing unit 522 is small, when the toner containing amount is full, the press urge force of the developing cartridge 502 becomes excessively large, and there is a concern that a gap adjusting spacer between the image carrier cartridge 501 and the developing cartridge 502 is deformed, or a rotational load of the image carrier 511 becomes excessively heavy.

Further, JP-A-7-146634 proposes to make the press urge force of the developing cartridge constant by devising a point of engaging the image carrier cartridge and the developing cartridge (a structure of installing the point of engaging the two units on a perpendicular line passing a gravitational center of the developing cartridge or a vicinity thereof).

However, although the technology described in JP-A-7-146634 is applicable to a mode in which a position of the gravitational center of the developing cartridge is not varied, in a number of modes in which the developing unit and the toner replenishing unit are integrated in the developing cartridge, the position per se of the gravitational center of the developing cartridge is varied and therefore, the situation of varying the press urge force of the developing cartridge cannot effectively be avoided.

SUMMARY OF THE INVENTION

The invention has been carried out in order to resolve the above-described technical problem and it is an object of thereof to provide a process cartridge capable of effectively restraining a component of varying a press urge force of a developing cartridge relative to an image carrier cartridge to thereby enable to provide a high quality image without a disturbance in the image and an image forming apparatus using the same.

According to the process cartridge of the invention, the developing cartridge is urged to press to the image carrier cartridge in the state of being positioned thereto, the total or the portion of the toner replenishing unit is supported by the image forming apparatus main body and therefore, even when the amount of containing the replenishing toner by at least the portion of the toner replenishing unit supported by the image forming apparatus main body is varied, the press urge force of the developing cartridge is not influenced thereby. Therefore, even when the amount of containing the toner is varied at at least the portion of the toner replenishing unit, the variation in the press urge force of the developing cartridge can effectively be restrained and a disturbance in an image can effectively be prevented by that amount.

Further, according to the image forming apparatus integrated with the process cartridge, the disturbance in the image in accordance with the variation in the press urge force of the developing cartridge can effectively be prevented and therefore, the image forming apparatus capable of providing the high quality image having the small disturbance in the image can simply be constructed.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

A detailed explanation will be given of the invention as follows based on embodiments shown in the attached drawings.

Embodiment 1

Figure 2:
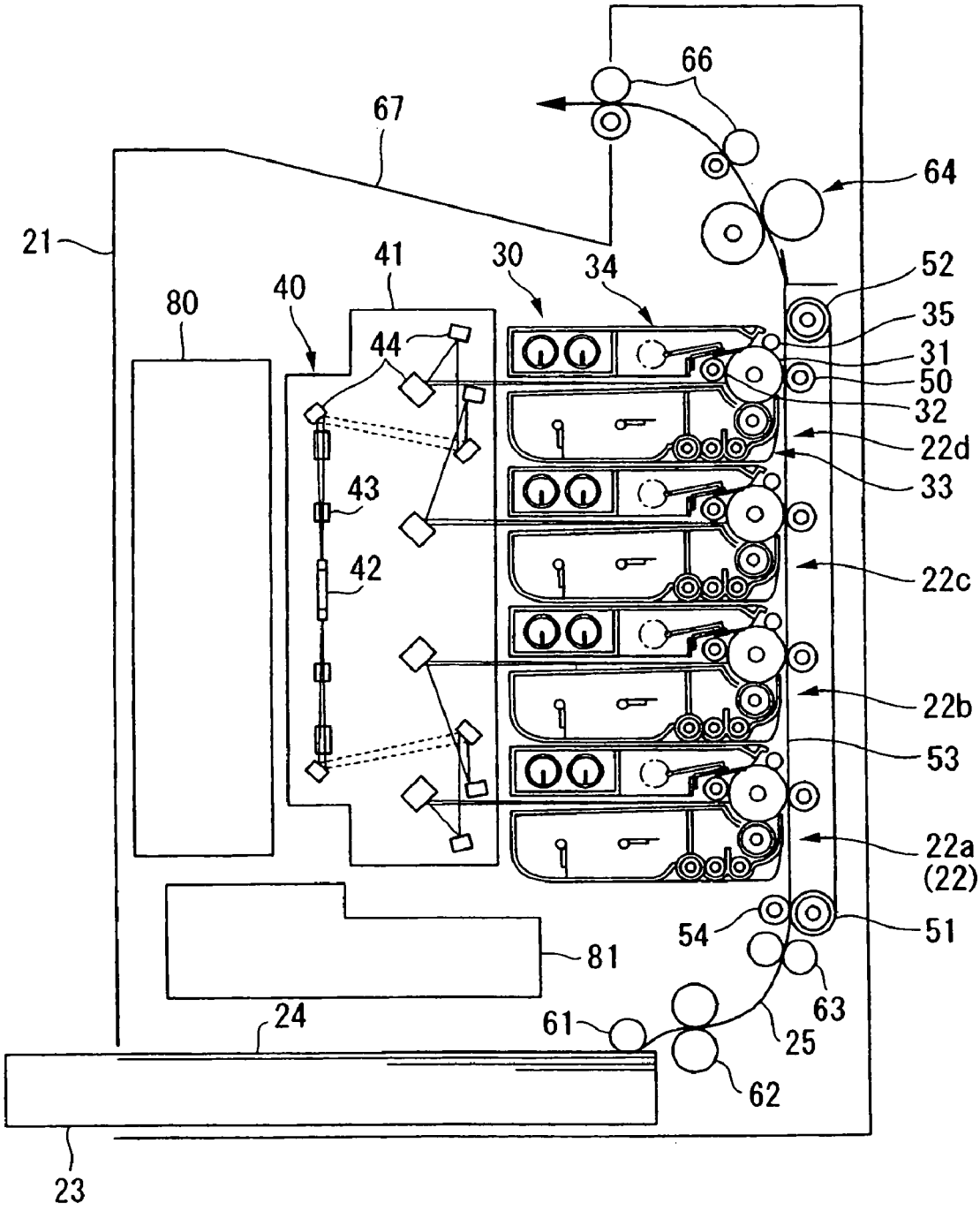
FIG. 2 is an explanatory view showing Embodiment 1 of an image forming apparatus according to the invention.

Total constitution of image forming apparatus FIG. 2 shows Embodiment 1 of an image forming apparatus to which the invention is applied.

Figure 1:
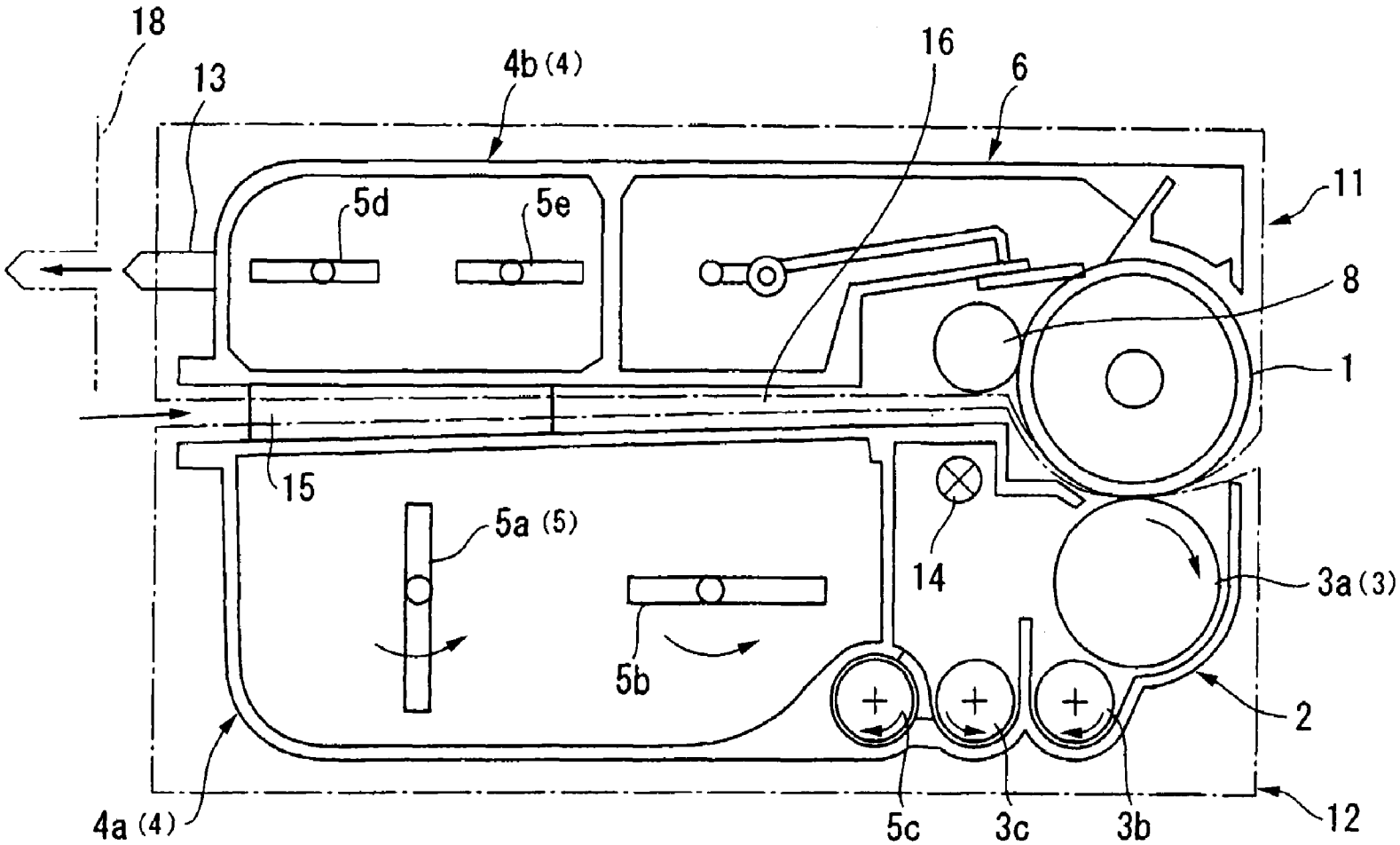
FIG. 1 is an explanatory view showing a process cartridge according to the invention and an image forming apparatus using the same.

That is, as shown by FIG. 1, the invention is characterized in a process cartridge attachably and detachably provided to an image forming apparatus main body 18 and including an image carrier 1, a developing unit 2 visualizing an electrostatic latent image on the image carrier 1 by a processing agent and a toner replenishing unit 4 for replenishing at least a toner to the developing unit 2, the process cartridge includes an image carrier cartridge 11 unitized into a single unit by including at least the image carrier 1 and positioned and supported by the image forming apparatus main body 18, and a developing cartridge 12 unitized into a single unit by including at least the developing unit 2 and urged to press to the image carrier cartridge 11 in a state of being positioned relative to the image carrier cartridge 11, the toner replenishing unit 4 is included in at least either of the image carrier cartridge 11 and the developing cartridge 12, and at least a portion 4*b* of the toner replenishing unit 4 is supported by the image forming apparatus main body.

In such technical means, the case is on the premise that the developing cartridge 12 is urged to press to the image carrier cartridge 11 to be positioned thereby.

Here, the developing cartridge 12 is normally pivotably supported by the image carrier cartridge 11 by way of an engaging portion 14, positioned thereto by a predetermined spacer or the like and urged to press to a side of the image carrier cartridge 11 by an urging element of an urge spring or the like.

Further, the image carrier cartridge 11 may include at least the image carrier 1 and may otherwise include, for example, a charging unit 8 for charging the image carrier 1, a cleaning unit 6 for cleaning a remaining toner on the image carrier 1 and the like, flirt her, may include a portion of the toner replenishing unit 4.

Further, the developing cartridge 12 needs to include at least the developing unit 2.

There is pointed out the developing unit 2 having a processing agent containing portion contained with a processing agent (including not only two components processing agent including a toner and a carrier but also one component processing agent of only a toner), the processing agent containing portion being arranged with various developing members 3 (for example, a processing agent carrier 3*a*, processing agent agitating and carrying member 3*b*, 3*c* and the like).

Further, the toner replenishing unit 4 may include not only a toner but also two components processing agent per se of a toner and a carrier.

Further, there is pointed out the toner replenishing unit 4 having a toner replenishing chamber contained with at least a toner, the toner replenishing chamber being arranged with a toner carrying member 5 capable of carrying a toner (for example, toner agitating and carrying members 5*a*, 5*b*, 5*d*, 5*e* and a dispensing member 5*c* for carrying a constant amount of a toner).

Further, as a layout of the toner replenishing unit 4, there is included any of a mode of including a total of the toner replenishing unit 4 in the image carrier cartridge 11, a mode of including a total of the toner replenishing unit 4 in the developing cartridge 12, and a mode of arranging the toner replenishing unit 4 at the two cartridges 11, 12 separately over the two cartridges 11, 12. Further, in FIG. 1, there is shown a mode of the toner replenishing unit 4 separately arranged with two parts 4*a*, 4*b*.

Further, according to the toner replenishing unit 4, at least a portion thereof (4*b* in FIG. 1) needs to be supported by the image forming apparatus main body 18.

In this way, when at least the portion 4*b* of the toner replenishing unit 4 is supported by the image forming apparatus main body 18, regardless of an amount of containing the toner in the portion 4*b* of the toner replenishing unit 4, a press urge force of the developing cartridge 12 is not influenced thereby. Therefore, when an amount of containing the toner at a portion other than the portion of the toner replenishing unit 4 is maintained as constant as possible, a variation in the press urge force of the developing cartridge 12 is restrained and a disturbance in an image and deformation and wear of parts can effectively be prevented by that amount.

Further, as a preferable mode of a process cartridge of this kind, as shown by FIG. 1, there is pointed out a process cartridge attachably and detachably provided to the image forming apparatus main body 18 and including the image carrier 1, the developing unit 2 for visualizing the electrostatic latent image on the image carrier 1 by the processing agent and the toner replenishing unit 4 for supplying at least the toner to the developing unit 2, the process cartridge including the image carrier cartridge 11 including at least the image carrier 1 and a total or a portion of the toner replenishing unit 4 to be unitized in a single unit and supported by the image forming apparatus main body 18, and the developing cartridge 12 including at least the developing unit 2 to be unitized in a single unit and urged to press to the image carrier cartridge 11 in the state of being positioned relative to the image carrier cartridge 11.

This is the mode of including at least the total or the portion (for example, 4*b*) of the toner replenishing unit 4 on the side of the image carrier cartridge 11.

According to the mode, the image carrier cartridge 11 includes a supporting portion 13 supported by the image forming apparatus main body 18, as a result, a total or the portion of the toner replenishing unit 4 is supported by the image forming apparatus main body 18.

Here, in the mode of including the portion (for example, 4*b*), of the toner replenishing unit 4 by the image carrier cartridge 11, the developing cartridge 12 includes a remaining portion (for example, 4*a*) of the toner replenishing unit 4. From other point of view, the toner replenishing unit 4 is arranged separately to the image carrier cartridge 11 and the developing cartridge 12.

Further, the total or the portion of the toner replenishing unit 4 needs to be connected to communicate with the developing unit 2 or a portion of the toner replenishing unit 4 by way of a deformable toner supply path 15.

That is, even when at least the portion of the toner replenishing unit 4 is supported by the image forming apparatus main body 18, in view of enabling to urge to press to the image carrier cartridge 11 by the developing cartridge 12, the deformable toner supply path 15 is needed.

There is pointed out a preferable constitution example of the toner supply path 15 formed to be surrounded by an elastic member for urging to press the developing cartridge 12 by the elastic member. According to the mode, deformability of the toner supply path 15 is ensured by the elastic member and the developing cartridge 12 is made to be able to urge to press to the image carrier cartridge 11 thereby.

Further, in preferably handling the toner supply path 15, it is preferable to close the portion of being connected to communicate with the toner supply unit 4 or the developing unit 2 by an openable seal member when used. In this case, before using the process cartridge, the toner supply path 15 is closed by the seal member and therefore, a situation of leaking the toner of the toner supply path 15 can be avoided in carrying the process cartridge or the like.

Further, as an example of a structure of supporting the image carrier cartridge 11, although a unit of supporting the image carrier 1 may be provided with a supporting portion, the toner supply unit 4*b* included in the image carrier cartridge 11 may be provided with the supporting portion 13 supported by the image forming apparatus main body 18.

Here, as a preferable example of a structure of supporting the image carrier cartridge 11, it is preferable that the supporting portion 13 of the toner replenishing unit 4*b* included in the image carrier cartridge 11 is positioned in a direction different from an axial direction of the image carrier 1. According to the mode, the image carrier 1 can stably be supported since the image carrier cartridge 11 is positioned in a plurality of different directions (for example, a plurality of directions of the axial direction of the image carrier 1 and a direction different therefrom).

Further, it is preferable to provide the supporting portion 13 of the toner replenishing unit 4*b* included in the image carrier cartridge 11 on a unit outer wall on a side of being remote from the image carrier 1. In this case, the image carrier cartridge 11 can stably be supported since a support point is remotely arranged.

Furthermore, it is preferable to provide a plurality of the supporting portions 13 of the toner replenishing unit 4*b* included in the image carrier cartridge 11. In this case, by increasing the support points, a burden of a weight of the process cartridge at each support point can be reduced.

Further, as a preferable layout of a path of writing the a latent image to the image carrier 1, there is pointed out a layout provided with a latent image writing path 16 at at least a vicinity of the port ion 4*b* of the toner replenishing unit 4 supported by the image forming apparatus main body 18. According to the mode, so far as the latent image writing path 16 is provided at at least the vicinity of the portion 4*b* of the toner replenishing unit 4 supported by the image forming apparatus main body 18, the position of the portion of the toner replenishing unit 4 is not changed and therefore, there is not a concern of blocking the latent image writing path 16.

Further, there is pointed out a preferable mode of the latent image writing path 16 in which the latent image writing path 16 interposed between the image carrier cartridge 11 and the developing cartridge 12.

The invention is not limited to the process cartridge but constitutes an object also the image forming apparatus capable of attachably and detachably mounting the process cartridge to the image forming apparatus main body 18.

In the drawing, the image forming apparatus is a color image forming apparatus of a so-to-speak tandem type, image forming units 22 (specifically, 22*a* through 22*d*) of four colors (yellow, magenta, cyan, black according to the embodiment) are aligned in a vertical direction at inside of an apparatus cabinet 21, a sheet feeding cassette 23 containing sheet 24 for supply is arranged therebelow, and a sheet carrying path 25 constituting a path of carrying the sheet 24 from the sheet feeding cassette 23 is arranged in a vertical direction at portions in correspondence with the respective image forming units 22.

According to the embodiment, the image forming units 22 (22*a* through 22*d*) are for forming toner images for yellow, for magenta, for cyan, for black successively from an upstream side of the sheet carrying path 25 and provided with a process cartridge 30 integrated with various process units and an exposing apparatus 40 for irradiating scanning light for forming images to the process cartridge 30.

Here, according to the process cartridge 30, for example, photosensitive drums 31, charging rolls 32 for previously charging the photosensitive drums 31, developing apparatus 33 for developing electrostatic latent images exposed to form by the exposing apparatus 40 on the charged photosensitive drums 31 by color toners (for example, negative polarity according to the embodiment), cleaning apparatus 34 for removing waste toners on the photosensitive drums 31, and erase lamps 35 for removing electricity on surfaces of the charged photosensitive drums 31 are integrally formed into a cartridge.

On the other hand, according to the exposing apparatus 40, a semiconductor laser, not illustrated, a polygonal mirror 42, a focusing lens 43 and a mirror 44 are stored in a case 41, light from the semiconductor laser is deflected to scan by the polygonal mirror 42, and light images are guided to exposure points on the photosensitive drums 31 via the focusing lens 43, the mirror 44.

Further, according to the embodiment, a carrying belt 53 moving to circulate along the sheet carrying path 25 is arranged at portions in correspondence with the respective photosensitive drums 31 of the respective image forming units 22.

The carrying belt 53 is constituted by a belt material (rubber or resin) capable of electrostatically adsorbing the sheet 24 and is hung over a pair of expanding rolls 51, 52 and according to the embodiment, the expanding roll 52 on an upper side constitutes a drive roll and the expanding roll 51 on a lower side constitutes a driven roll.

Furthermore, an entry portion (portion opposed to the expanding rolls 51) of the carrying belt 53 is arranged with a sheet adsorbing roll 54, and by applying an adsorbing voltage at a high voltage to the sheet adsorbing roll 54, the sheet 24 is adsorbed to the carrying belt 53. Further, transcribing rolls 50 are arranged on a rear face side of the carrying belt 53 in correspondence with the photosensitive drums 31 of the respective image forming units 22, and the photosensitive drums 31 and the sheet 24 on the carrying belt 53 are further brought into close contact with each other by the transcribing rolls 50. Further, a predetermined transcribing bias by a transcribing bias power source is pertinently applied between the transcribing roll 50 and the photosensitive drum 31.

Further, according to the embodiment, a pickup roll 61 for delivering the sheet 24 at predetermined timings is provided at a vicinity of the sheet feeding cassette 23 and the sheet 24 is delivered to a transcribing position via a carrying roll 62 and a registration roll 63.

Further, a fixing apparatus 64 is provided at the sheet carrying path 25 disposed on a downstream side of the most downstream side image forming unit 22*d*, a discharging roll 66 for discharging sheet is provided on a downstream side of the fixing apparatus 64, and discharged sheet is contained in a containing tray 67 formed at an upper portion of the apparatus cabinet 21.

Further, in FIG. 2, notation 80 designates a high voltage power source for supplying a high voltage to apparatus devices for a high voltage and notation 81 designates a low voltage power source for supplying a low voltage to apparatus devices for a low voltage.

An image forming process of such an image forming apparatus is as follows.

Now, as shown by FIG. 2, at the respective image forming units 22 (22*a* through 22*d*), the photosensitive drums 31 are charged by the charging rolls 32, latent images are formed on the photosensitive drums 31 by the exposing apparatus 40 and thereafter, visual images (toner images) are formed by the developing apparatus 33.

On the other hand, the sheet 24 from the sheet feeding cassette 23 is reeled out by the pickup roll 61 at predetermined timings, delivered to an adsorbing position of the carrying belt 53 via the carrying roll 62 and the registration roll 63 and is delivered to the transcribing position in a state of being adsorbed by the carrying belt 53.

Further, the toner images on the photosensitive drums 31 at the respective image forming units 22 are respectively transcribed onto the sheet 24 by the transcribing rolls 50, and fixed toner images of respective color components on the sheet 24 are fixed by the fixing apparatus 64 and the fixed sheet 24 is discharged to the containing tray 67.

Outline of Process Cartridge

Figure 3:
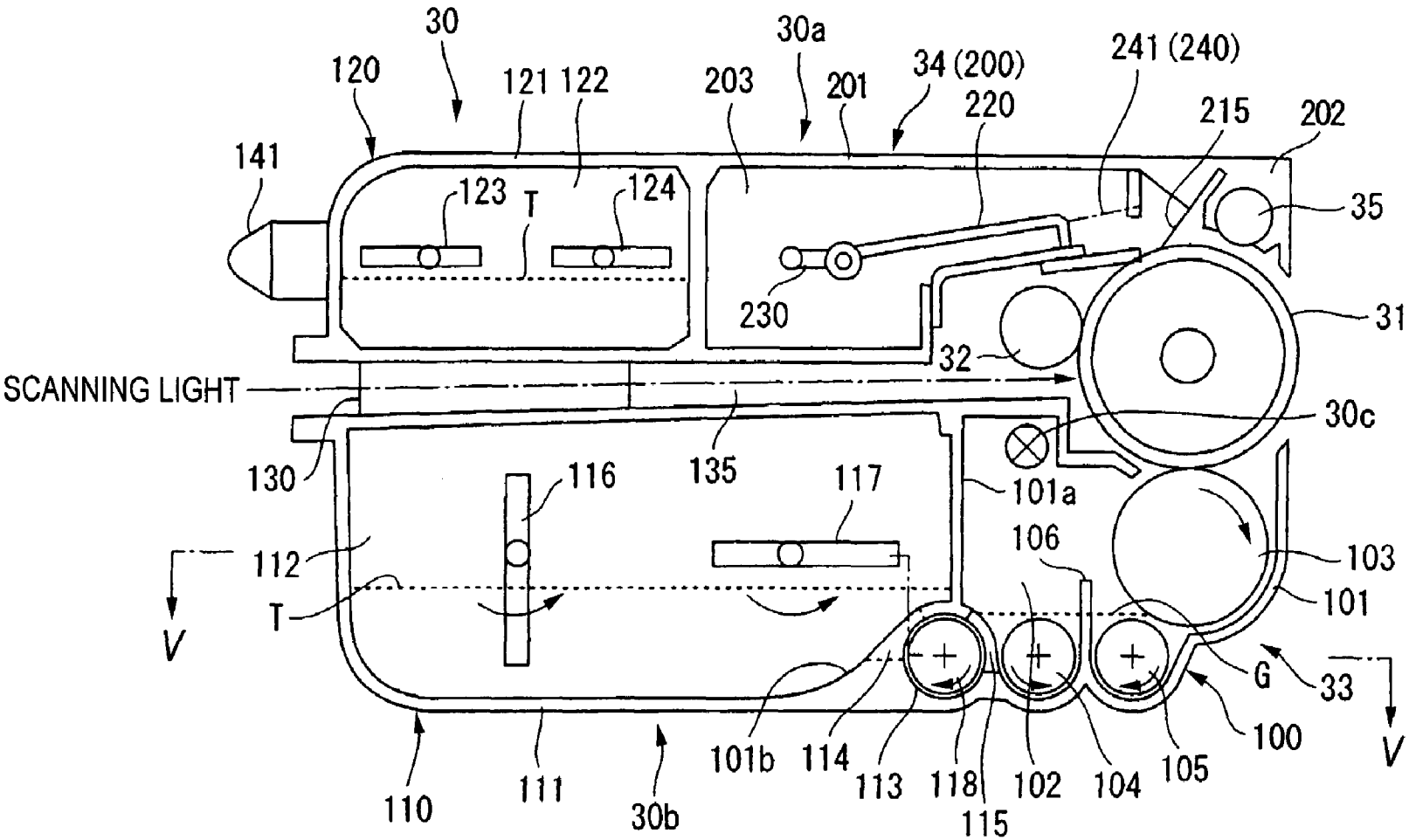
FIG. 3 is an explanatory view showing details of the process cartridge used in the embodiment.

Further, FIG. 3 shows details of the process cartridge 30 used in the embodiment.

In a drawing, the process cartridge 30 is provided with a photosensitive cartridge 30*a* including the photosensitive drum 31, the charging roll 32, a portion of the developing apparatus 33, the cleaning apparatus 34 as well as the erase lamp 35 as a device of removing electricity from the photosensitive drums 31 before a cleaning processing, and a developing cartridge 30*b* provided in a state of being pivotable and positioned to the photosensitive cartridge 30*a* and including a principal portion of the developing apparatus 33 on a lower side of the photosensitive cartridge 30*a*.

Particularly, according to the embodiment, the developing apparatus 33 is provided with a developing unit 100 opposed to the photosensitive drum 31 for visualizing the electrostatic latent image on the photosensitive drum 31 by a processing agent G including a toner and a carrier, and toner replenishing units 110, 120 (according to the embodiment, a separated type of the main toner replenishing unit 110, the sub toner replenishing unit 120 is adopted) for supplying a toner T to the developing unit 100.

Further, the photosensitive cartridge 30*a* is constructed by a constitution of integrating a cleaning unit 200 unitized with the cleaning apparatus 34 and the sub toner replenishing unit 120 in a horizontal direction, further, the developing cartridge 30*b* is constructed by a constitution of integrating the developing unit 100 and the main toner replenishing unit 110 in the horizontal direction.

Further, according to the embodiment, the developing cartridge 30*b* is provided at the portion of the developing unit 100 pivotably by a pivot shaft 30*c* relative to the photosensitive cartridge 30*a* positioned to be fixed to the apparatus cabinet 21, a scanning path 135 capable of passing scanning light from the exposing apparatus 40 is ensured between the photosensitive cartridge 30*a* and the developing cartridge 30*b*, spacers 130 including elastic members are interposed on both sides of the respective part cartridges 30*a*, 30*b* at a vicinity of an entry of the scanning path 135 for urging to press the developing cartridge 30*b* to the photosensitive cartridge 30*a*. Further, an urging element of an urge spring or the like may naturally be used in place of or in addition to the spacer 130.

Figure 4A:
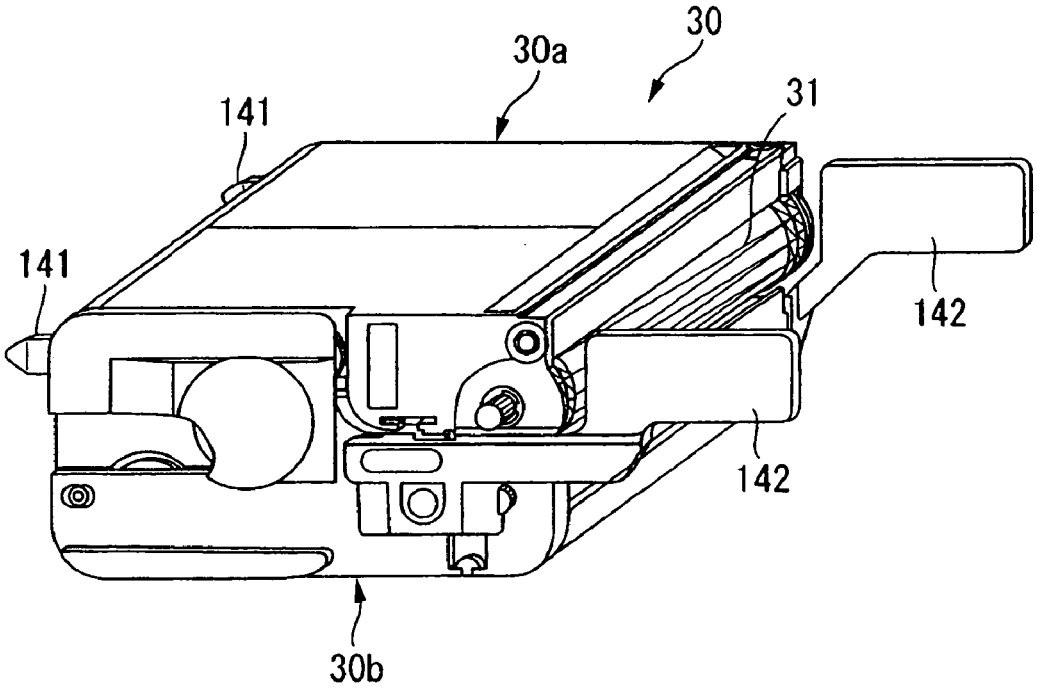
FIG. 4A is a view in an arrow mark direction viewing the process cartridge used in the embodiment from one side direction.
Figure 4B:
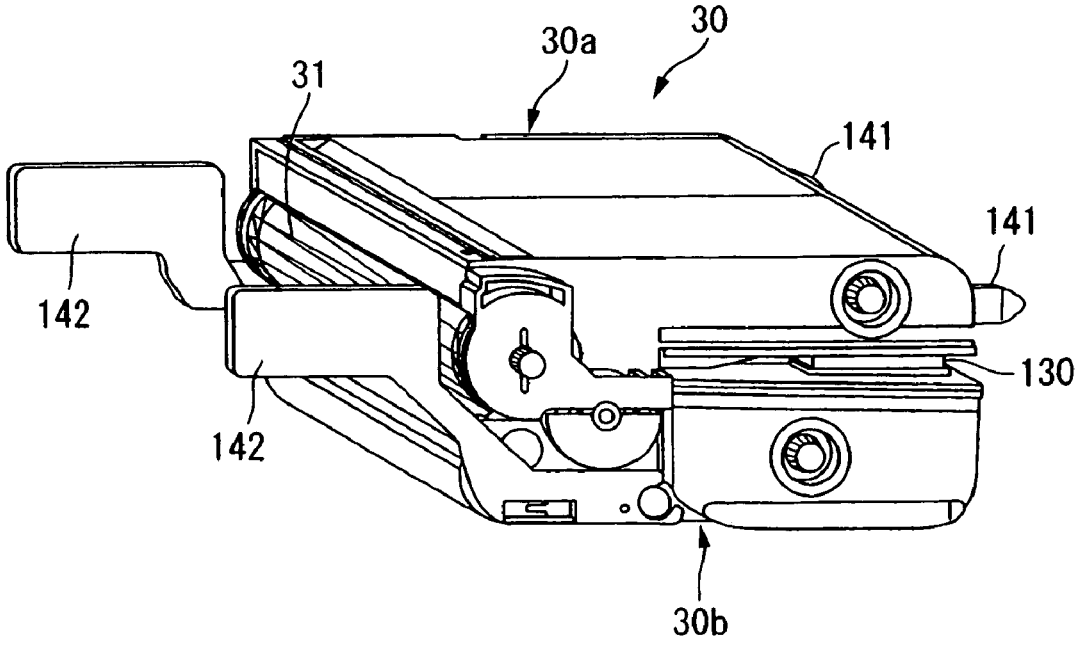
FIG. 4B is a view in an arrow mark direction viewing the process cartridge used in the embodiment from other side direction on an opposed side.

Further, according to the embodiment, as shown by FIGS. 3, 4A and 4B, the sub toner replenishing unit 120 of the photosensitive cartridge 30*a* is provided with, for example, a pair of support projections 141 extended in a direction orthogonal to an axial direction of the photosensitive drum 31.

Further, when the process cartridge 30 is mounted to a cartridge receive portion (not illustrated) of the apparatus cabinet 21, both ends of a support shaft of the photosensitive drum 31 is fixed to a predetermined position by a fixing receive member, not illustrated, provided at the cartridge receive portion, and a drive transmitting member (drive transmitting gear) arranged at one end of the photosensitive drum 31 rotatable relative to the support shaft is connected to be engaged with a driving system, not illustrated, provided at the cartridge receive portion. Further, the pair of support projections 141 are engaged with portions of the cartridge receive portion to be engaged (recess portions or holes or the like) and the photosensitive cartridge 30*a* is positioned and fixed to the apparatus cabinet 21. Here, the cartridge receive portion of the apparatus cabinet 21 will do so far as the cartridge receive portion can contain to hold the process cartridge 30, the cartridge receive portion may be constituted by using a cabinet frame per se or may be constituted by providing a separate member to the cabinet frame.

Particularly, according to the embodiment, the support projection 141 is provided at a unit outer wall remote from the photosensitive drum 31 and is positioned in a direction different from an axial direction of the photosensitive drum 31 and therefore, the support projection 141 can stably support the photosensitive cartridge 30*a*. Furthermore, a pair of the support projections 141 are provided, support points of the photosensitive cartridge 30*a* are constituted by four thereof, a burden of a weight of the process cartridge 30 at each support point is reduced, further, also torsional deformation of the process cartridge 30 is corrected.

Further, in FIGS. 4A and 4B, notation 142 designates a grabbing arm in operating to attach and detach the process cartridge 30.

Developing Apparatus

An explanation will be given of the respective units 100, 110, 120 constituting the developing apparatus 33 used in the embodiment.

Developing Unit

Figure 5:
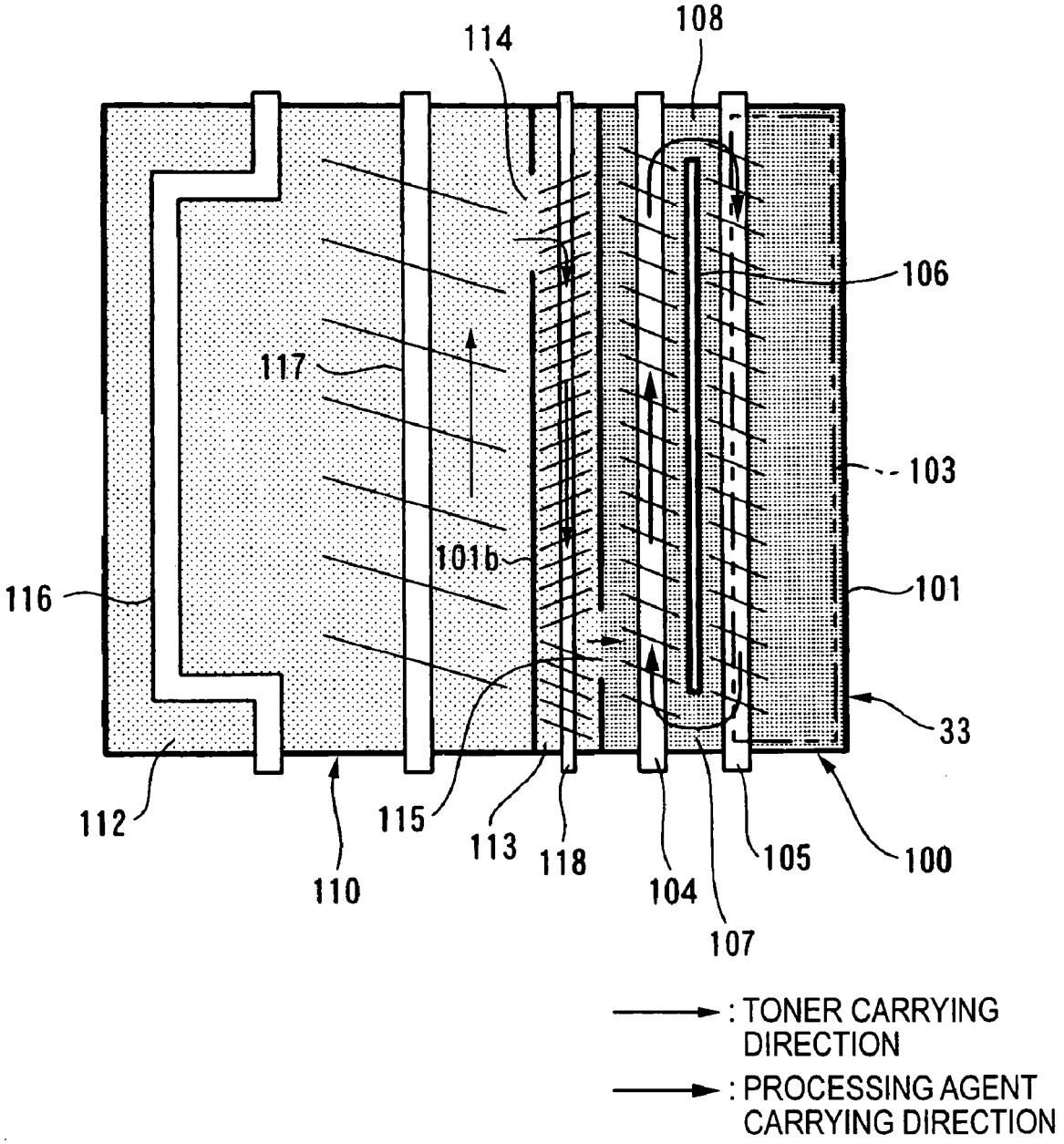
FIG. 5 is a partially broken explanatory view of a developing cartridge taken along a line V-V of FIG. 3.

According to the embodiment, as shown by FIG. 3 through FIG. 5, a so-to-speak two components developing system is adopted for the developing unit 100, a developing housing 101 opened to a side of the photosensitive drum 31 is provided on a lower side of the photosensitive drum 31, inside of the developing housing 101 is constituted as a processing agent containing chamber 102 capable of containing the processing agent G including a toner and a carrier, and a developing roll 103 for carrying the processing agent is arranged at a portion facing the opening of the developing housing 101. Further, according to the developing unit 100, the processing agent containing chamber 102 is divided in two by a partition wall 106 extended along the axial direction of the developing roll 103, by opening communicating ports 107, 108 at both ends in a longitudinal direction of the partition wall 106, a processing agent circulating path is constituted at the processing agent containing chamber 102, the processing agent circulating path is arranged with a pair of agitating and carrying augers 104, 105 along the axial direction of the developing roll 103, and the processing agent G in the processing agent circulating path is carried while being agitated.

Further, although according to the embodiment, the agitating and carrying auger 105 proximate to the developing roll 103 serves to function to supply the processing agent to the developing roll 103, a processing agent supply member (roll, paddle or the like) may naturally be added separately from the agitating and carrying auger 105. Further, a surrounding of the developing roll 103 is provided with a trimming member for restricting a thickness of the processing agent, a recovery member for recovering the unused processing agent or the like as necessary.

Main Toner Replenishing Unit

Further, as shown by FIG. 3 through FIG. 5, the main toner replenishing unit 110 includes a main replenishing housing 111 partially serving as a depth side partition wall of the developing housing 101 of the developing unit 100 and inside of the main replenishing housing 111 is constituted as a toner replenishing chamber contained with the replenishing toner T to be able to be replenished.

Particularly, according to the embodiment, the toner replenishing chamber is divided into a toner containing chamber 112 contained with the replenishing toner T and a dispensing chamber 113 communicated with the toner containing chamber 112 for quantitatively supplying the toner T to the developing unit 100. Here, the dispensing chamber 113 is provided with a thick-walled portion 101*b* proximately to a lower portion of a depth side partition wall 101*a* of the developing housing 101 and is constituted as a long path (tunnel-like path) having a section substantially in a circular shape extended along the axial direction of the developing roll 103 at inside of the thick-walled portion 101*b*.

Further, a portion of the depth side in a longitudinal direction of the thick-walled portion 101*b* facing the toner containing chamber 112 is opened with a dispensing entry opening 114 and a toner supply port 115 is opened at a portion of the thick-walled portion 101*b* facing the dispensing chamber 113 on a side opposed to the dispensing entry opening 114 in the longitudinal direction.

Further, inside of the toner containing chamber 112 is arranged with an agitator 116 for agitating and carrying the replenishing toner T and an agitator 117 for agitating and carrying the toner T agitated and carried by the agitator 116 to the dispensing entry opening 114 of the dispensing chamber 113.

Here, as the agitators 116, 117, there is used a mode of attaching an agitating film of a PET film or the like to a rotating rod, a mode of adjusting a direction of carrying the toner by pertinently providing cuts at the agitating film, or an agitating and carrying coil spring or the like. Further, in FIG. 5, the mode of agitators 104, 105 is schematically shown.

On the other hand, the dispensing chamber 113 is arranged with a dispensing auger 118 along the longitudinal direction. Particularly, according to the embodiment, the dispensing auger 118 is provided with a spiral blade a diameter of which is substantially the same as or smaller than those of the agitating and carrying augers 104, 105 in the developing unit 100, further, a pitch of the dispensing auger 118 is set to be equal to or smaller than pitches of the agitating and carrying augers 104, 105.

Further, according to the embodiment, a lower end of the toner supply port 115 is opened to be disposed downward from a position of a surface of the processing agent G contained in the processing agent containing chamber 102. That is, the toner supply port 115 may be disposed at least below the position of a surface of the processing agent G of the processing agent containing chamber 102, the replenishing toner T is made to be able to supply horizontally to a portion of the processing agent containing chamber 102 piled up with the processing agent to thereby ensure a performance of mixing the replenishing toner T to the processing agent G.

In this case, when a pressing force of extruding the replenishing toner T from the dispensing chamber 113 from the toner supply port 115 is larger than an inner pressure by the processing agent G of the processing agent containing chamber 102, even when the toner supply port 115 faces a lower side of the surface of the processing agent G, the replenishing toner T can stably be supplied.

Particularly, when a lower end of the toner supply port 115 is set to be on a lower side of a rotational center of the agitating and carrying auger 104, the toner T is replenished from the lower side of the rotational center of the agitating and carrying auger 104 and therefore, the replenished toner T is entrapped by the agitating and carrying auger 104 and is swiftly agitated to be mixed with the processing agent G.

Further, although the dispensing entry opening 114 may pertinently be opened, from a view point of sufficiently increasing an inner pressure of the toner at inside of the dispensing chamber 113, it is preferable that the dispensing entry opening 114 is wider than the toner supply port 115, further, it is preferable that a length of carrying the replenishing toner T of the dispensing chamber 113 is sufficiently longer than the dispensing entry opening 114.

Further, a diameter dimension, a blade pitch, a revolution number and the like of the dispensing auger 118 are selected such that the inner pressure of the toner based on a force of carrying the toner by the dispensing auger 118 becomes larger than the inner pressure of the processing agent G at inside of the processing agent containing chamber 102 applied to the toner supply port 115 (depending on a carrying force of the agitating and carrying auger 104).

In this case, although according to the embodiment, diameter dimensions of the dispensing auger 118 and the agitating and carrying augers 104, 105 are substantially the same, for example, by making the diameter dimension of the dispensing auger 118 smaller than the diameter dimensions of the agitating and carrying augers 104, 105, further stable supply can be constituted.

Further, with regard to a capacity of the toner containing chamber 112, when the capacity of the toner containing chamber 112 is made to be larger than a capacity of the dispensing chamber 113, or a total capacity of the dispensing chamber 113 and the processing agent containing chamber 102, it is preferable in view of stabilizing supply of the toner.

Further, the capacity mentioned here signifies an amount of containing the toner or an amount of containing the processing agent, respectively.

Furthermore, according to the embodiment, rotational centers of the agitator 116, 117 are arranged to be disposed upward from the dispensing auger 118 and the agitating and carrying augers 104, 105.

Therefore, it is not necessary to carry up the toner T from the toner containing chamber 112 to the dispensing chamber 113, the processing agent containing chamber 102 and therefore, the inner pressure of the toner in the dispensing chamber 113 can effectively be increased, and the toner can smoothly be supplied to the processing agent containing chamber without deteriorating the inner pressure of the toner at the dispensing chamber 113.

Sub Toner Replenishing Unit

Further, according to the embodiment, as shown by FIG. 3, the sub toner replenishing unit 120 includes a sub replenishing housing 121 contiguous to a rear face side of the cleaning unit 200 and is constituted as a toner replenishing chamber 122 contained with the replenishing toner T to be able to replenish at inside of the sub replenishing housing 121.

Further, inside of the toner replenishing chamber 122 is arranged with a pair of agitators 123, 124 for agitating and carrying the replenishing toner T.

Figure 6:
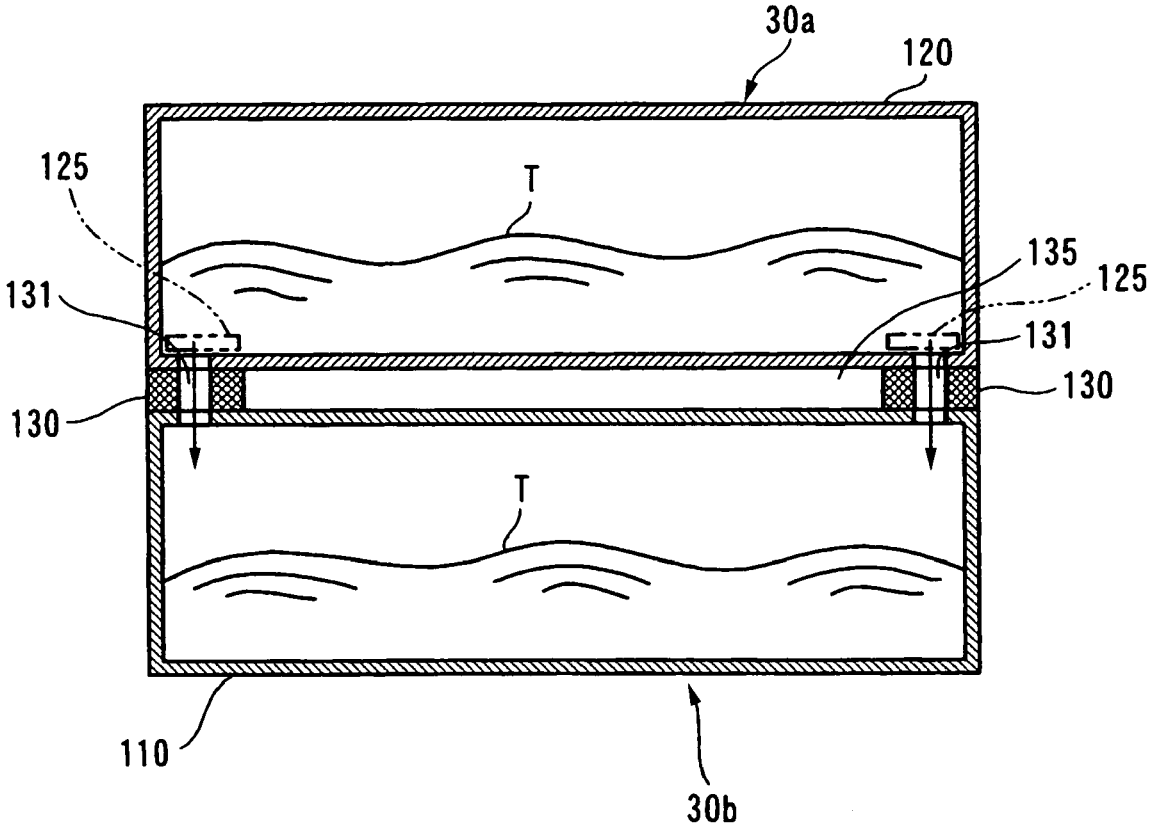
FIG. 6 is an explanatory view showing an example of a structure of communicating a main toner replenishing unit and a sub toner replenishing unit.

Here, as a structure of communicating the sub toner replenishing unit 120 and the main toner replenishing unit 110, as shown by FIG. 6, there is used the spacer 130 including the elastic member formed with a communicating path (a toner supply path) 131. Although according to the embodiment, the spacers 130 are provided at the two portions on the both sides between the respective units 110, 120, and the respectively formed with the toner supply paths 131, for example, the toner supply path 131 may be formed only at either one of the spacers 130, or, the spacer 130 may be provided only at one portion on one side thereof and the spacer 130 may be formed with the toner supply path 131.

Further, according to the embodiment, with regard to the sub toner replenishing unit 120, as shown by an imaginary line in FIG. 6, it is preferable to close a portion connected with the toner supply path 131 when the portion is not used by a seal member 125 capable of being opened when used. In this case, not only there is not a concern of bringing the toner in the sub toner replenishing unit 120 into the toner supply path 131 to bring about clogging when the process cartridge 30 is not used (for example, in transporting) but also there can effectively be avoided a situation in which the toner in the sub toner replenishing unit 120 is filled to be deviated to a side of the main toner replenishing unit 110 and a density of filling the toner at inside of the main toner replenishing unit 110 is unnecessarily increased.

Further, according to the embodiment, when a predetermined amount of the toner T is replenished from the main toner replenishing unit 110 to the developing unit 100, simultaneously therewith, the toner T at inside of the sub toner replenishing unit 120 is replenished to the main toner replenishing unit 110. Therefore, inside of the main toner replenishing unit 110 is filled with substantially a constant amount of the toner T until the sub toner replenishing unit 120 is emptied, and a change in a weight of the developing cartridge 30*b* is restrained to be small.

In this case, the photosensitive cartridge 30*a* is positioned and fixed to the cartridge receive portion of the apparatus cabinet 21 and therefore, a change in the amount of containing the toner of the sub toner replenishing unit 120 does not effect an influence on the change in the weight of the developing cartridge 30*b* at all.

Therefore, a variation in a force of urging to press the developing cartridge 30*b* to the photosensitive cartridge 30*a* is restrained until the sub toner replenishing unit 120 is emptied and a disturbance in an image can effectively be prevented by that amount.

Further, since the photosensitive cartridge 30*a* is positioned and fixed to the apparatus cabinet 21, at least a position of a lower side face of the photosensitive cartridge 30*a* forming the scanning path 135 is not changed and even when the position of the developing cartridge 30*b* pivotably supported by the photosensitive cartridge 30*a* is varied, a concern of blocking the scanning path 135 is reduced by that amount.

Cleaning Apparatus

Figure 7:
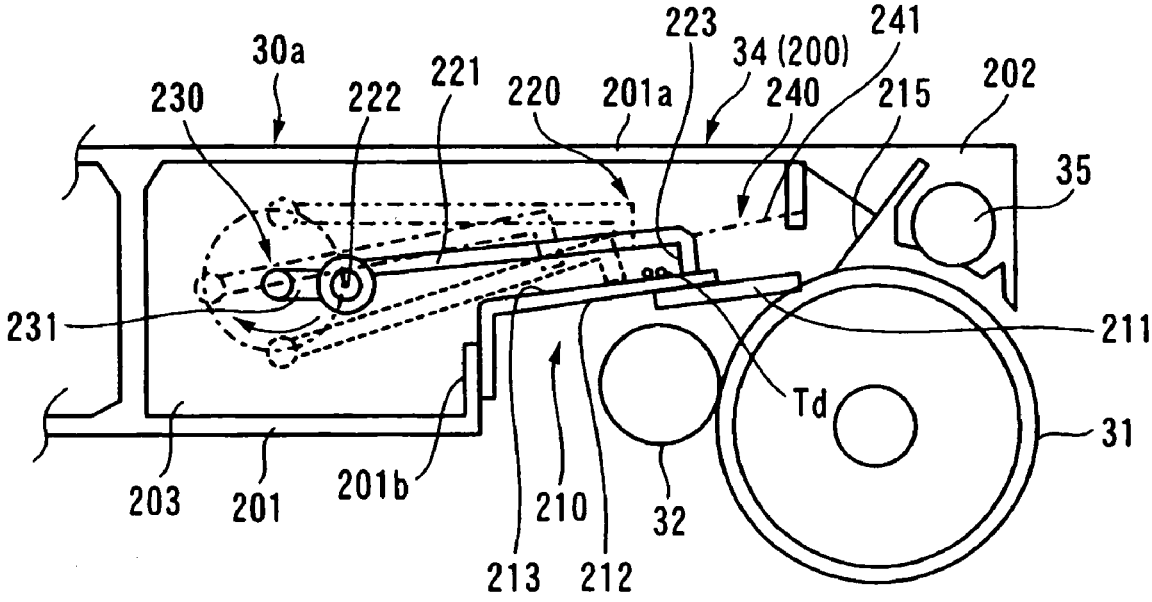
FIG. 7 is an explanatory view of an essential portion of a cleaning apparatus used in the embodiment.

Further, according to the embodiment, as shown by FIG. 7, the cleaning apparatus 34 is integrated to the photosensitive cartridge 30*a* as the cleaning unit 200.

The cleaning unit 200 includes a cleaning housing 201 opened to be opposed to the photosensitive drum 31, inside of the cleaning housing 201 is constituted as a waste toner containing chamber 203 capable of containing the waste toner, and an upper wall 201*a* of the cleaning housing 201 is extended to a side of the photosensitive drum 31 in an eaves-like shape.

Further, an opening lower edge portion 201*b* of the cleaning housing 201 is arranged with a cleaning blade 210, the cleaning blade 210 is attached with a blade holder 212 substantially in an L-like shape at a side wall portion (not illustrated) hung down from the opening lower edge portion 201*b* and both sides of the upper wall 201*a*, attached with a blade main body 211 including an elastic member of urethane rubber or the like on an outer side of a front end portion of the blade holder 212, a front end of the blade main body 211 is brought into elastic contact with the photosensitive drum 31 to be opposed to a direction of rotating the photosensitive drum 31 (counterclockwise direction in FIG. 7).

On the other hand, an opening upper edge portion of the cleaning housing 201 (vicinity of a front end of the upper wall 201*a* according to the embodiment) is provided with a film seal 215 of polyurethane or the like, a front end portion of the film seal 215 is brought into elastic contact with the photosensitive drum 31 along a rotational direction thereof, and the waste toner recovered by the cleaning blade 210 is prevented from being scattered.

According to the embodiment, a portion of the cleaning blade 210 other than a portion thereof attached to the cleaning housing 201 is arranged substantially in parallel with the eaves-like portion of the upper wall 201*a* of the cleaning housing 201 and is constituted as a waste toner storing portion 213 for temporarily storing the waste toner scraped off by the cleaning blade 210 (in correspondence with an inner face of the blade holder 212 in this example). Particularly, in this example, the waste toner storing portion 213 constitutes a downward slope toward the waste toner containing chamber 203 and a performance of carrying the waste toner Td can be promoted.

Further, although according to the embodiment, the waste toner storing portion 213 is constituted only by the cleaning blade 210, the waste toner storing portion 213 may be constituted by using not only the cleaning blade 210 but also a portion of the cleaning housing 201.

Further, a space constituting a portion recessed from the photosensitive drum 31 is ensured between the cleaning housing 201 and the cleaning blade 210 and therefore, the charging roll 32 is arranged by utilizing the recessed portion.

Further, a holding block 202 of the erase lamp 35 is provided at a front end of the upper wall 201*a* of the cleaning housing 201.

Further, according to the embodiment, inside of the cleaning housing 201 is provided with a waste toner carrying member 220 for carrying the waste toner Td scraped off by the cleaning blade 210 to the side of the waste toner containing chamber 203.

The waste toner carrying member 220 includes a carrying plate 221 as a member element spanning an interval from the waste toner containing chamber 203 to the waste toner storing portion 213, an end portion of the carrying plate 221 on a side of the waste toner containing chamber 203 is provided with a drive input portion 222 capable of inputting a drive force from outside and an end portion of the carrying plate 221 on a side of the photosensitive drum 31 is provided with a projected portion 223 capable of being brought into contact with the waste toner storing portion 213.

Here, although the carrying plate 221 may stay to be a plate-like shape, from a viewpoint of light-weighted formation and effectively avoiding the waste toner Td from being piled up to an upper face portion, it is preferable to form an opening 224 at a portion other than the projected portion 223 and the drive input portion 222 of the carrying plate 221. Further, it is not necessarily needed that the portion of forming the projected portion 223 is the end portion of the carrying plate 221, the portion may be a portion remote from the end portion, further, although a number of the projected portions 223 may at least be a single one, even when a plurality thereof is provided, the portions will do. Further, a method of forming the projected portion 223 may pertinently be selected such that the projected portion 223 is formed by folding to bend the front end portion of the carrying plate 221, or the projected portion 223 may be formed at a portion of the carrying plate 221 integrally therewith or separately therefrom.

Further, it is not necessarily needed that the member element of the waste toner carrying member 220 is the carrying plate 221 but, for example, a member element having a frame structure or the like may naturally be used.

Further, according to the embodiment, as shown by, for example, FIG. 7, the drive input portion 222 of the waste toner carrying member 220 is inputted with a drive force in a shape of a rotating locus, and the drive force in the shape of the rotating locus is easily provided by driving to rotate, for example, a crankshaft 231 which is a kind of a rotational driving mechanism 230 by constituting a rotational center thereby.

However, according to the embodiment, the waste toner carrying member 220 is provided with an attitude restricting mechanism 240 for restricting an attitude of moving the waste toner carrying member 220.

According to the embodiment, the attitude restricting mechanism 240 is constituted by an urge spring 241 one end of which is engaged with a side of the projected portion 223 of the waste toner carrying member 220 and other end of which is engaged with a portion of the cleaning housing 201 for urging the waste toner carrying member 220 in a direction of being remote from the drive input portion 222.

Particularly, according to the embodiment, the urge spring 241 is arranged in a direction skewed to a direction of moving forward and rearward the waste toner carrying member 220.

Figure 8B:
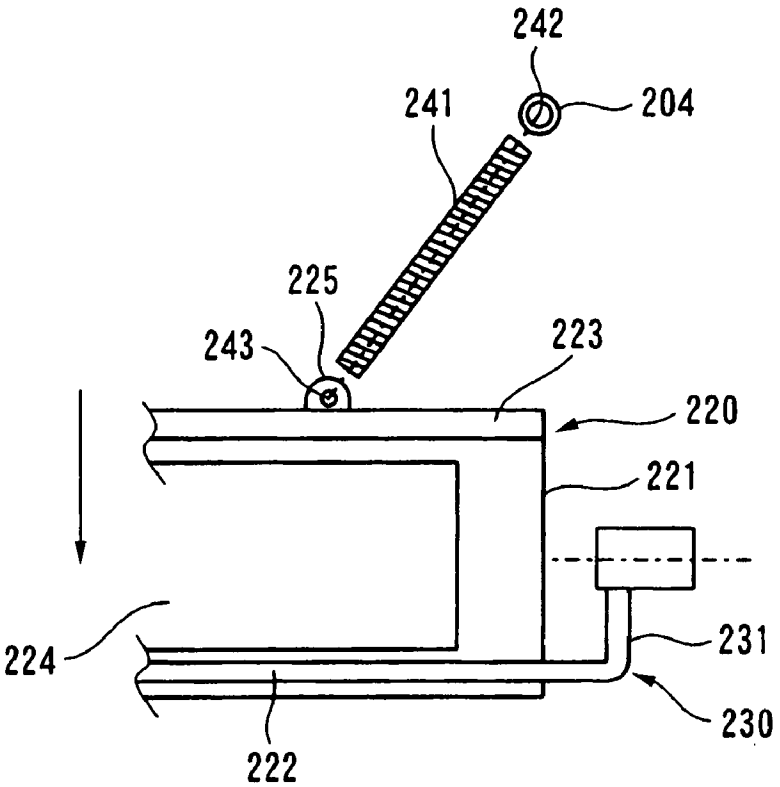
FIGS. 8A and 8B are explanatory views showing a state of operating an urge spring in moving forward and rearward a waste toner carrying member.
Figure 8A:
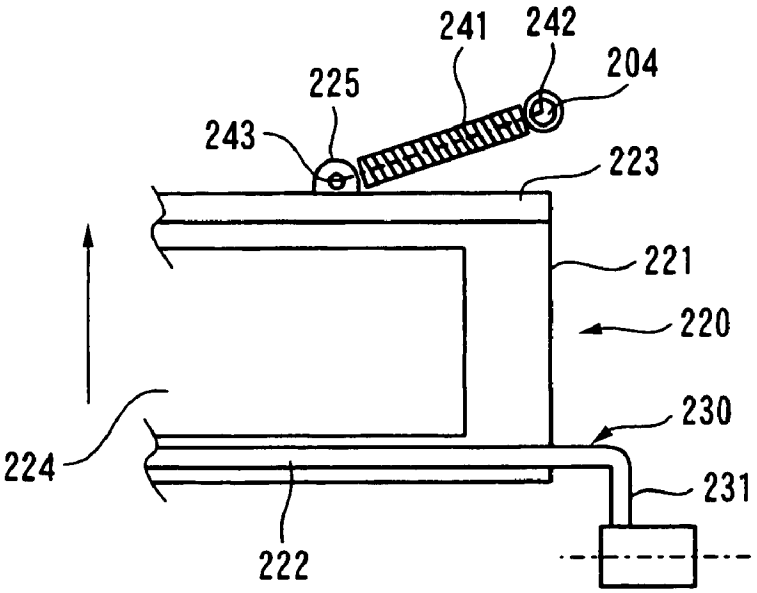

Here, as a structure of attaching the urge spring 241, in FIG. 7 and FIGS. 8A and 8B, locking hooks 242, 243 are provided at the both ends of the urge spring 241, the locking hook 242 on one side is engaged with an engaging projection 204 on a side of the cleaning housing 201, and the locking hook 243 on other side is engaged with an engaged piece 225 provided at an end portion of the waste toner carrying member 220 on a side of the projected portion 223.

Further, although according to the embodiment, as a structure of attaching the urge spring 241, the engaging projection 204 is provided at inside of the cleaning housing 201, the structure is not limited thereto but, for example, in a mode of opening a locking hole communicating with outside at the cleaning housing 201, although there is a concern of leaking the waste toner, in such a case, the locking hole may be sealed by a seal member. It is preferable that the seal member serves also as a label or the like pasted on CRU.

When the urge spring 241 is attached to the waste toner carrying member 220 in this way, as shown by FIG. 7 and FIGS. 8A and 8B, when the drive input portion 222 of the waste toner carrying member 220 is inputted with the drive force in the shape of the rotational locus, the projected portion 223 of the waste toner carrying member 220 is moved forward and rearward along the waste toner storing portion 213 by following the drive force.

At this occasion, the urge spring 241 restricts a range of changing the attitude of the waste toner carrying member 220 relative to the change in the position of the drive input portion 222 of the waste toner carrying member 220. According to the example, when the waste toner carrying member 220 is moved rearward, the projected portion 223 is moved in contact with the waste toner along the waste toner storing portion 213 and when the waste toner carrying member 220 is moved forward, the projected portion 223 is moved in noncontact with the waste toner on the waste toner storing portion 213. A specific behavior thereof will be described later.

Particularly, according to the embodiment, the urge spring 241 is arranged in the direction skewed to the direction of moving forward and rearward the waste toner carrying member 220 and therefore, not only space shaping formation of an arranged space can be achieved but also an amount of elongating and contracting the urge spring 241 relative to the amount of moving the waste toner carrying member 220 can be set to be small and it is preferable in view of a point of capable of alleviating a load variation in the force of driving the waste toner carrying member.

Next, operation of the cleaning apparatus 34 used in the embodiment will be explained.

Figure 9A:
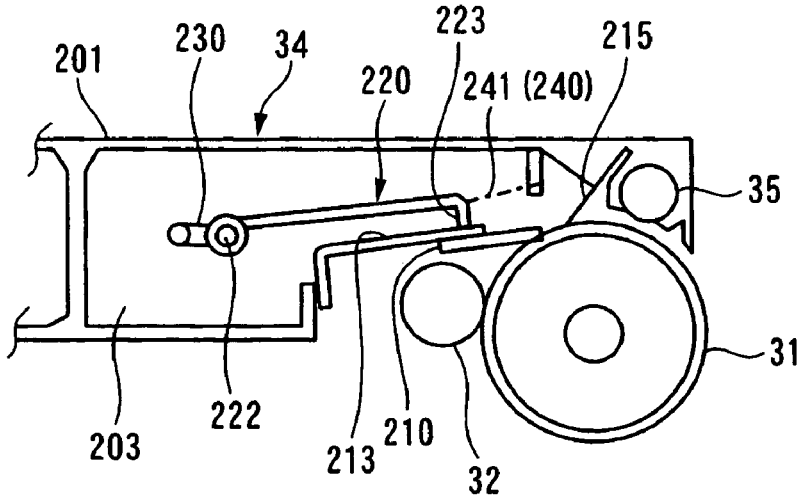
FIGS. 9A through 9C are explanatory views showing operational states in moving rearward the waste toner carrying member in the cleaning apparatus according to Embodiment 1.

Now, when as shown by FIG. 7 and FIG. 9A, the toner remaining on the photosensitive drum 31 is scraped off by the cleaning blade 210, the scraped off waste toner Td is piled up on the cleaning blade 210 and a vicinity thereof, after having been successively extruded by the scraped off toner, the waste toner Td is piled up on the waste toner storing portion 213 (in correspondence with the inner face of the blade holder 211 according to the example).

Under the state, now, when the drive input portion 222 of the waste toner carrying member 220 is disposed at a position of FIG. 9A, the waste toner carrying member 220 is arranged at a forwardmost position.

At this occasion, the urge spring 241 urges the waste toner carrying member 220 in a direction of being remote from the drive input portion 222, when by adjusting a relationship between a position of the drive input portion 222 of the waste toner carrying member 220 and a position of a locking point of the urge spring 241 on a side of the cleaning housing 201, a portion of a component of the urge force of the urge spring 241 is operated in a direction of bringing the projected portion 223 of the waste toner carrying member 220 into contact with the waste toner on the waste toner storing portion 213, the projected portion 223 of the waste toner carrying member 220 is brought into contact with the waste toner on the waste toner storing portion 213.

Figure 9B:
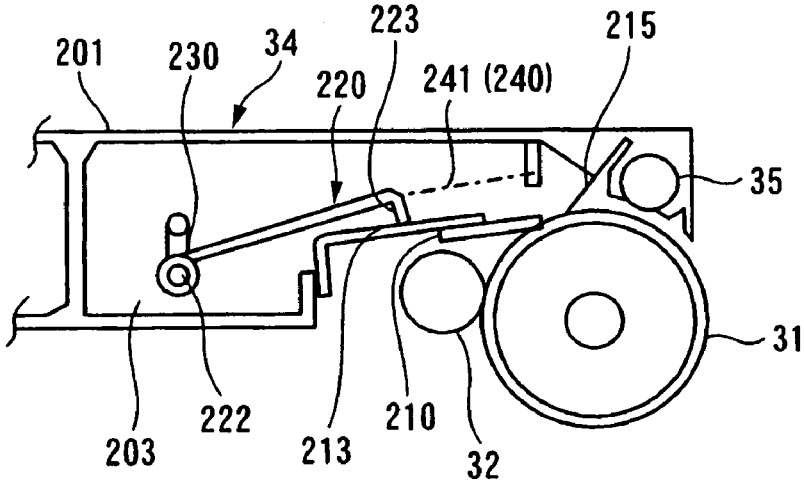

By rotating downward the position of the of the drive input portion 222 by the rotationally driving mechanism 230, as shown by FIG. 9B, the waste toner carrying member 220 is moved rearward while being gradually inclined, at this occasion, the projected portion 223 of the waste toner carrying member 220 carries the waste toner on the waste toner storing portion 213 to the side of the waste toner containing chamber 203.

Further, when the drive input portion 222 of the waste toner carrying member 220 reaches a lowermost point, the attitude of the waste toner carrying member 220 is brought into the steepest inclined state, from a view point of maintaining a state of bringing the projected portion 223 of the waste toner carrying member 220 and the waste toner storing portion 213 into contact with each other, it is efficient that a portion of the waste toner carrying member 220 other than the projected portion 223 is prevented from being brought into contact with the waste toner storing portion 213.

Figure 9C:
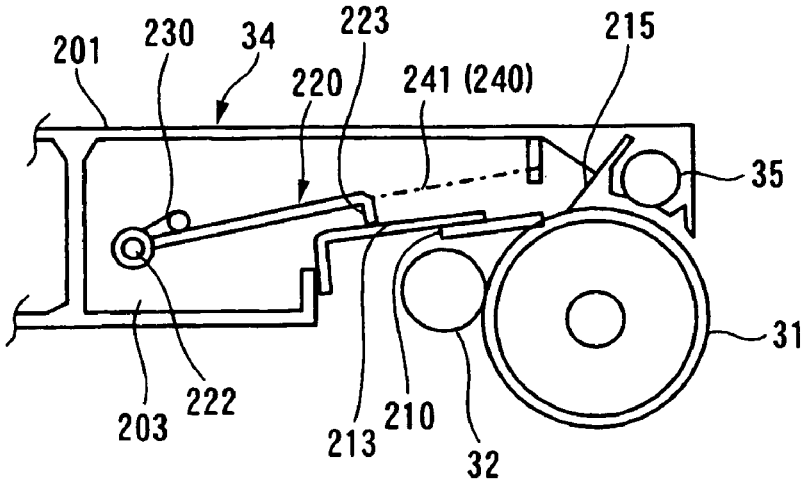

Thereafter, when the drive input portion 222 of the waste toner carrying member 220 is rotated to a position of FIG. 9C, the waste toner carrying member 220 is further moved rearward while gradually making the inclined attitude gradual. At this occasion, the urge spring 241 is still operated to press the waste toner carrying member 220 to the side of the waste toner storing portion 213 and therefore, the projected portion 223 of the waste toner carrying member 220 is moved in contact with the waste toner Td along the waste toner storing portion 213 to move the waste toner Td to the side of the waste toner containing chamber 203.

Figure 10A:
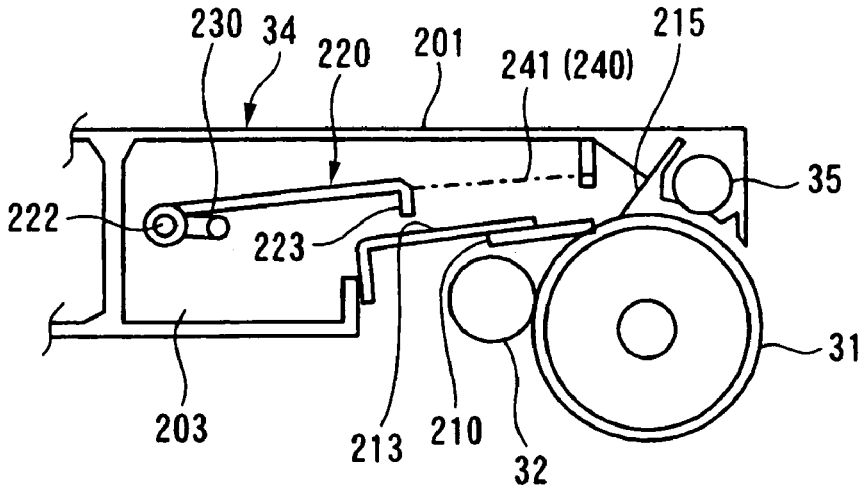
FIGS. 10A through 10C are explanatory views showing operational states in moving forward the waste toner carrying member.

Further, although according to the embodiment, as shown by FIG. 9C and FIG. 10A, even when the waste toner carrying member 220 reaches the rearmost position, the projected portion 223 of the waste toner carrying member 220 is not moved to an end portion of the waste toner storing portion 213 proximate to the waste toner containing chamber 203, the waste toner carried to a vicinity of the end portion of the waste toner storing portion 213 proximate to the waste toner containing chamber 203 is pressed by the waste toner carried thereafter and is contained successively to the waste toner containing chamber 203.

Further, according to the embodiment, as shown by FIG. 1A, when the waste toner carrying member 220 reaches the rearmost position, the waste toner carrying member 220 is pulled by the urge force of the urge spring 241, the projected portion 223 of the waste toner carrying member 220 is separated from the waste toner on the waste toner storing portion 213 to reach a state immediately before being arranged in noncontact therewith.

That is, the waste toner carrying member 220 is urged in a predetermined direction by the urge spring 241 and therefore, based on the relationship between the position of the drive input portion 222 of the waste toner carrying member 220 and the position of the locking point of the urge spring 241 on the side of the cleaning housing 201, the attitude of arranging the waste toner carrying member 220 is determined. At this occasion, at a stage of shifting the waste toner carrying member 220 to move forward, there may be constituted a layout in which the projected portion 223 of the waste toner carrying member 220 and the waste toner on the waste toner storing portion 213 are arranged to be in noncontact with each other.

Figure 10B:
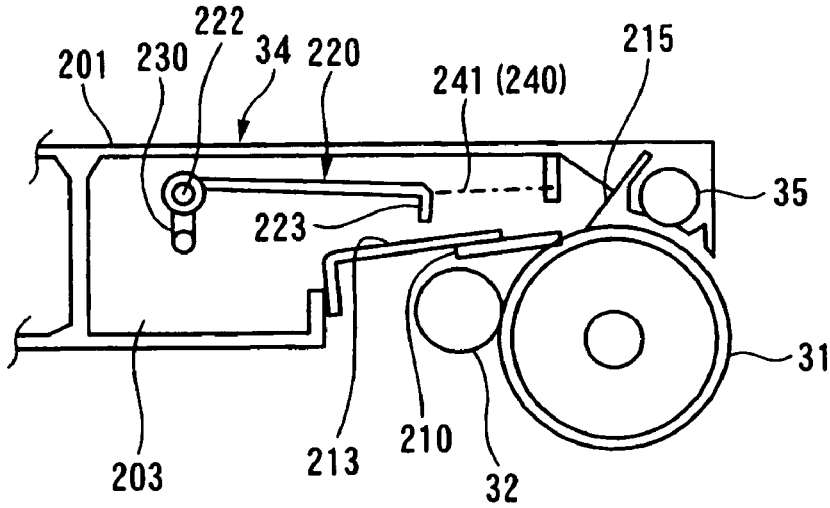

Thereafter, when as shown by FIG. 10B, the drive input portion 222 of the waste toner carrying member 220 is rotated upward, the waste toner carrying member 220 is moved forward while changing the inclined attitude to move upward the side of the drive input portion 222.

At this occasion, the waste toner carrying member 220 is urged by the urge spring 241, and when the position of the drive input portion 222 of the waste toner carrying member 220 is moved upward, the position of arranging the waste toner carrying member 220 is further moved upward and therefore, the projected portion 223 of the waste toner carrying member 220 and the waste toner on the waste toner storing portion 213 stay to be arranged in noncontact with each other.

Figure 10C:
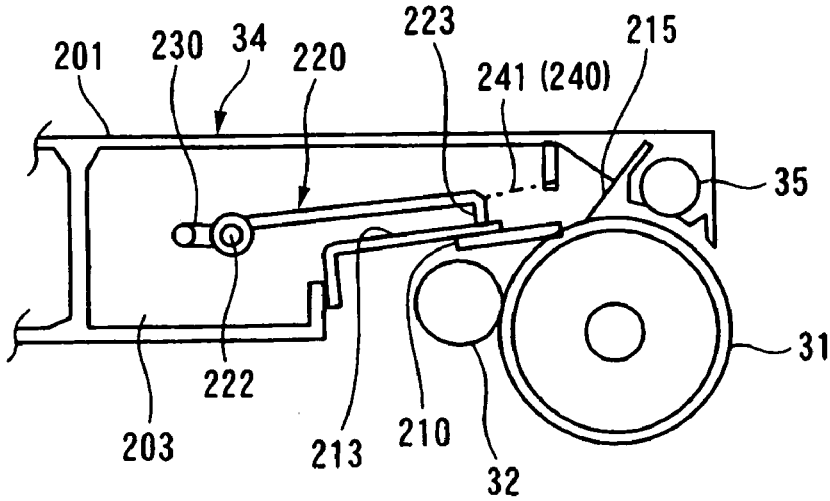

Thereafter, when as shown by FIG. 10C, the drive input portion 222 of the waste toner carrying member 220 is rotated in a direction of moving down along an upper dead center, the waste toner carrying member 220 is moved forward again while changing the inclined attitude to gradually approach the side of the waste toner storing portion 213. Further, at a time point at which the waste toner carrying member 220 reaches the forwardmost position, the projected portion 223 of the waste toner carrying member 220 is arranged to be in contact with the waste toner of the waste toner storing portion 213 again.

In this way, when the waste toner carrying member 220 is moved forward, the projected portion 223 of the waste toner carrying member 220 is moved in noncontact with the waste toner on the waste toner storing portion 213 and therefore, there is effectively avoided a situation of pressing back the waste toner on the waste toner storing portion 213 in accordance with operation of moving forward the waste toner carrying member 220 and a performance of carrying the waste toner is excellently maintained.

Thereafter, the behavior of FIGS. 9A through 9C and FIGS. 10A through 10C is repeated.

Further, although according to the embodiment, there is constructed a mode in which the waste toner cartridge member is moved always in contact with the waste toner storing portion 213 in moving rearward, the invention is not limited thereto but, for example, the waste toner carrying member 220 may naturally be moved initially in noncontact with the waste toner storing portion 213 and moved in contact therewith from a midway.

Particularly, according to the embodiment, when the drive input portion 222 is disposed at the position of the upper dead center, the waste toner carrying member 220 maintains the substantially horizontal uppermost attitude and moved on the locus which is not projected upward from the uppermost attitude, further, moved forward while maintaining the substantially horizontal attitude and therefore, a space on the upper side of the waste toner containing chamber 203 and a space on the upper side of the waste toner storing portion 213 can be set to be narrow and the cleaning apparatus 34 can be thinned by that amount.

Further, according to the embodiment, the waste toner carrying member 220 is provided with the opening 224 and therefore, there is not a concern of piling up the waste toner on the waste toner carrying member 220 in carrying the waste toner by the waste toner carrying member 220, further, also there is not a concern of scattering the waste toner by a wind pressure by an air resistance.

Further, although according to the embodiment, the waste toner carrying member 220 is moved in contact therewith along the waste toner storing portion 213 in moving rearward, the embodiment is not limited thereto but there may be constructed a constitution in which although the waste toner carrying member 220 is not brought into contact with the waste toner storing portion 213, the waste toner carrying member 220 is moved in contact with the waste toner on the waste toner storing portion 213. In this case, the waste toner carrying member 220 is made to be prevented from being brought into direct contact with the waste toner storing portion 213 in moving rearward and therefore, it is preferable in view of a point of reducing a concern of transmitting vibration to the side of the photosensitive drum 31 unnecessarily in accordance with moving the waste toner carrying member 220.

Drive System of Developing Apparatus, Cleaning Apparatus

According to the embodiment, a drive system 300 of the developing apparatus 33, the cleaning apparatus 34 shown below is used.

Figure 11:
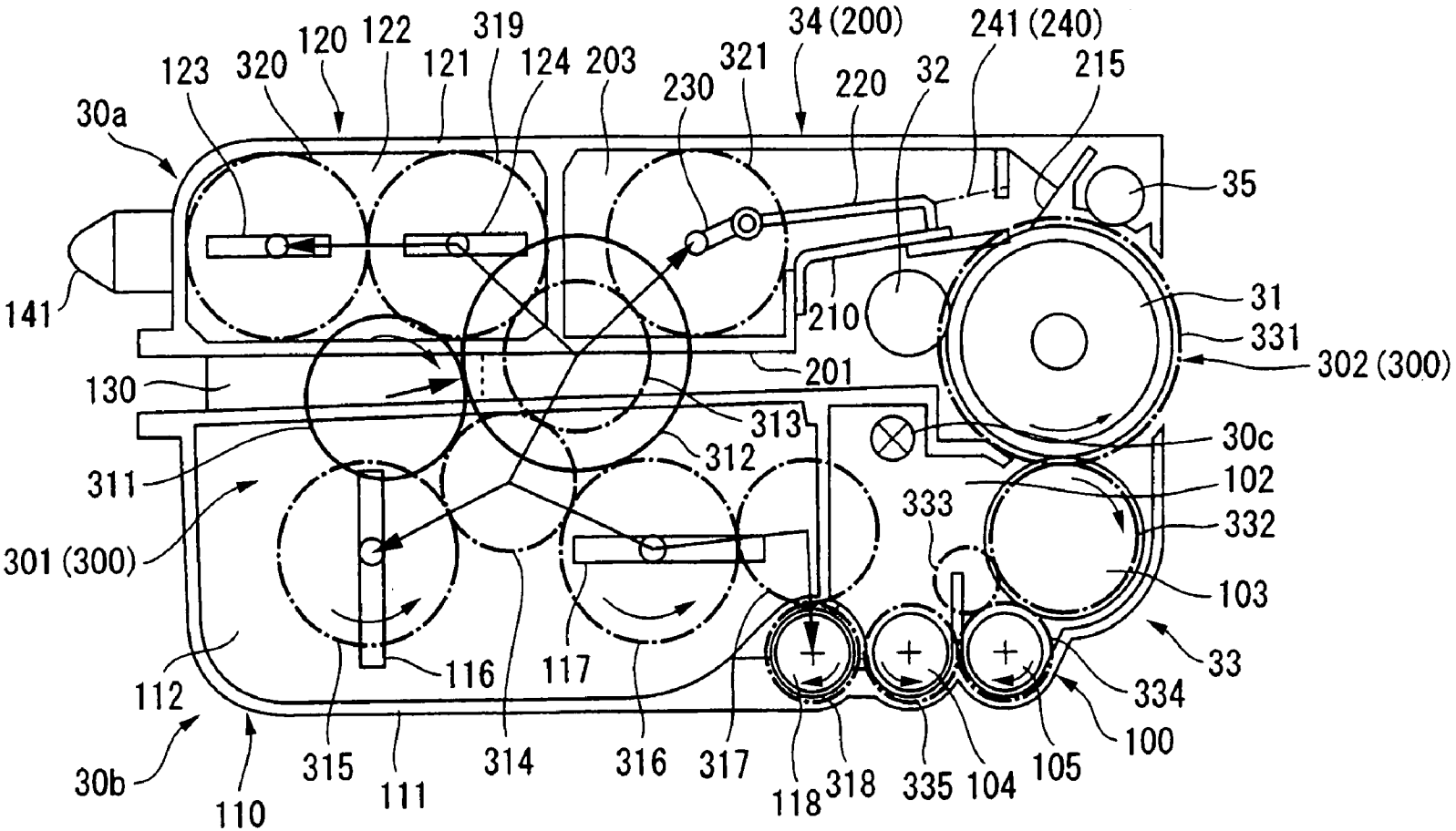
FIG. 11 is an explanatory view showing an example of a carrying drive system, a developing drive system used in the embodiment.

That is, as shown by FIG. 11, the drive system 300 used in the embodiment is provided with a carrying drive system 301 for driving respective driven elements of the toner replenishing units 110, 120 of the developing apparatus 33 and respective drive elements of the cleaning unit 200 as the cleaning apparatus 34 by the same drive source, and a developing drive system 302 for driving respective drive elements of the developing unit 100 of the developing apparatus 33 by using a drive source separate from that of the carrying drive system 301.

Here, the carrying drive system 301 includes a drive input gear 311 connected to drive by the drive source, not illustrated, a first stage of a drive transmission gear 312 is brought in mesh with the drive input gear 311, a coaxial transmission gear 313 is provided coaxially with the drive transmission gear 312, drive transmission gears 315, 316 connected to the agitators 116, 117 of the main toner replenishing unit 110 are brought in mesh with the coaxial transmission gear 313 via an idler gear 314, further, a dispensing gear 318 connected to the dispensing auger 118 is brought in mesh with the drive transmission gear 316 on one side via an idler gear 317.

Further, according to the carrying drive system 301, drive transmission gears 319, 320 connected to the agitators 123, 124 of the sub toner replenishing unit 120 are brought in mesh with the coaxial transmission gear 313, and also a drive transmission gear 321 connected to a rotating shaft of the rotational deriving mechanism 230 of the cleaning unit 200 is brought in mesh therewith.

On the other hand, the developing drive system 302 is provided with, for example, a drive transmission gear 331 coaxially with the photosensitive drum 31, a drive transmission gear 332 connected to the developing drive roll 103 is brought in mesh with the drive transmission gear 331. Further, drive transmission gears 334, 335 connected to the agitating and carrying augers 105, 104 are successively brought in mesh with the drive transmission gear 332 via an idler gear 333.

Further, not only a mode in which the drive source of the developing drive system 302 and the drive source of the carrying drive system 301 are separate from each other, but also the same drive source may be used therefor when the respectives can be driven independently from each other.

In this way, according to the embodiment, the carrying drive system 301 and the developing drive system 302 are constituted by separate routes and therefore, in comparison with the mode of cooperatively moving the developing drive system 302 and the carrying drive system 301, it is not necessary to always drive the toner carrying members (agitators 116, 117, dispensing auger 118, agitators 123, 124), the waste toner carrying member 220 in the developing operation, the toner carrying member and the waste toner carrying member 220 can be restrained from being worn to be deteriorated and service life of the process cartridge 30 can be improved by that amount.

Further, the toner carrying members and the waste toner carrying member 220 having a large variation in load, the photosensitive drum 31 and the developing roll 103 requesting rotational accuracy are driven separately and therefore, vibration produced owing to the variation in the load of the toner carrying member, the waste toner carrying member 220 or the like does not effect an influence on rotation of the photosensitive drum 31 or the developing roller 103 and a defect in an image can be prevented beforehand.

Further, when the carrying drive system 301 is provided with a connection separable element (pivoting gear or the like) by which drive of respective drive elements of the toner replenishing units 110, 120 can be separated from being connected, only the waste toner carrying operation can be carried out separately from the operation of replenishing the toner. Further, when there is provided a connection separable element capable of separating connection of the drive of a portion of the drive elements of the toner replenishing unit 110, for example, the dispensing auger 118, only the operation of agitating and carrying the toner by the agitators 116, 117, 123, 124 in the toner replenishing units 110, 120 is carried out without making the dispensing auger 118 carry out the toner replenishing operation and the replenishing toner can also be stopped periodically.

Embodiment 2

Figure 12:
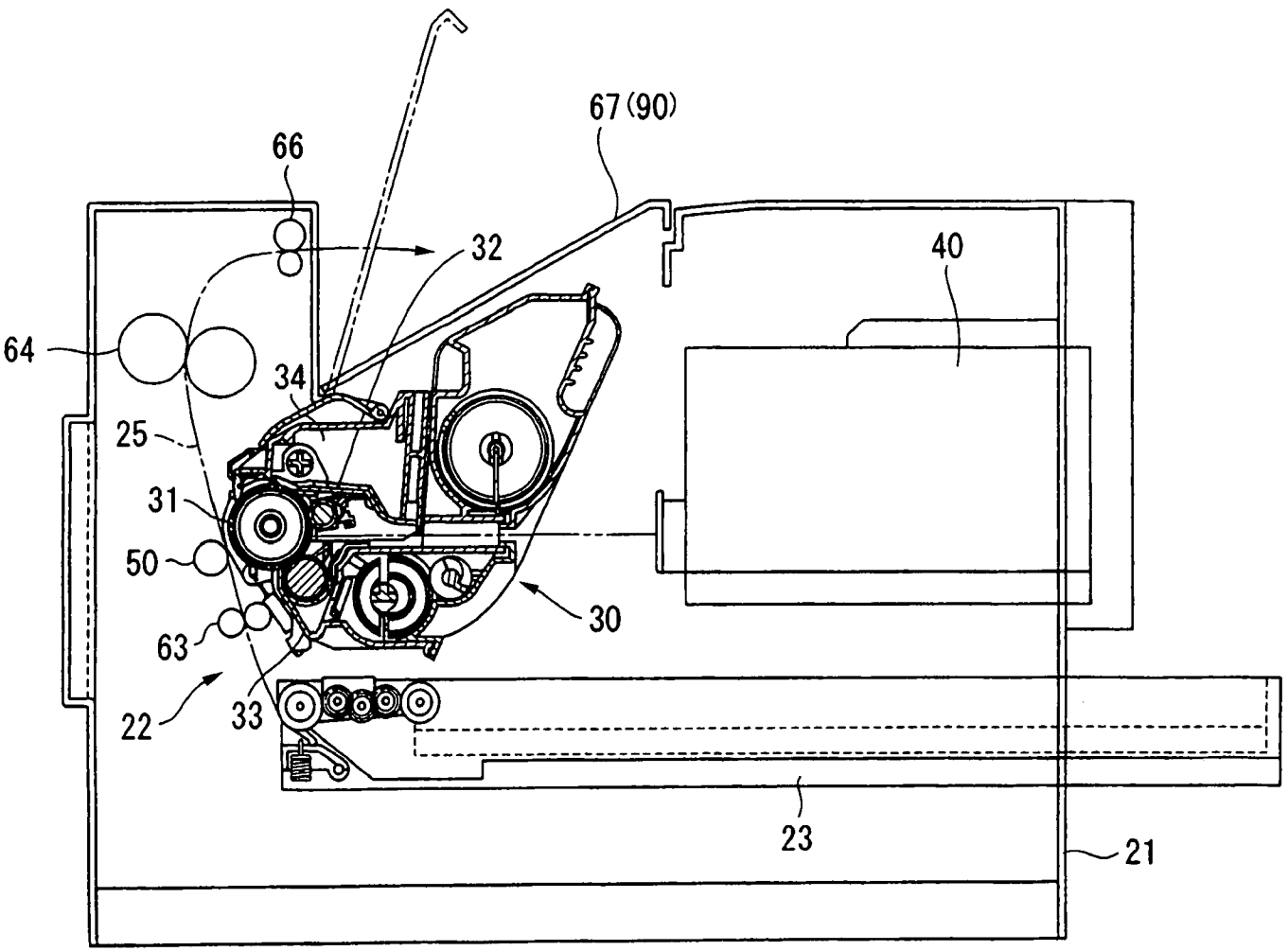
FIG. 12 is an explanatory view showing Embodiment 2 of an image forming apparatus according to the invention.

FIG. 12 shows Embodiment 2 of an image forming apparatus to which the invention is applied.

In the drawing, the image forming apparatus is a monochromatic machine for forming a monochromatic image, substantially similar to Embodiment 1, the image forming unit 22 of the electronic photography system is mounted in the apparatus cabinet 21, the sheet feeding cassette 23 is arranged on the lower side of the image forming unit 22 in the apparatus cabinet 21, the containing tray 67 is provided at the upper portion of the apparatus cabinet 21, and the sheet carrying path 25 for guiding the sheet 24 delivered from the sheet feeding cassette 23 to the image forming unit 22, the containing tray 67 is provided on the rear side (left side in FIG. 12) in the apparatus cabinet 21. Further, constituent elements similar to those of Embodiment 1 are attached with notations similar to those of Embodiment 1 and a detailed explanation thereof will be omitted.

Figure 13:
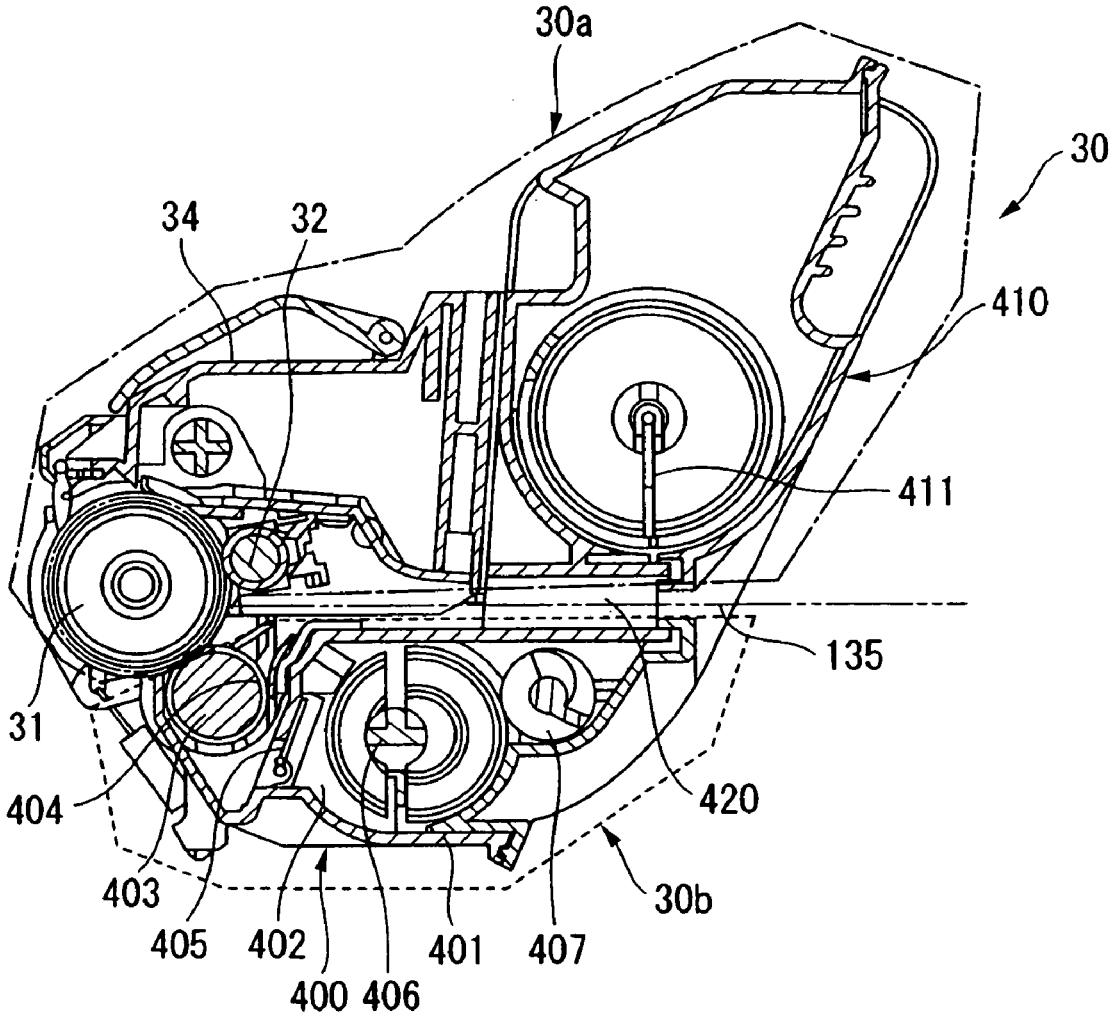
FIG. 13 is an explanatory view showing a process cartridge used in the embodiment.
Figure 14:
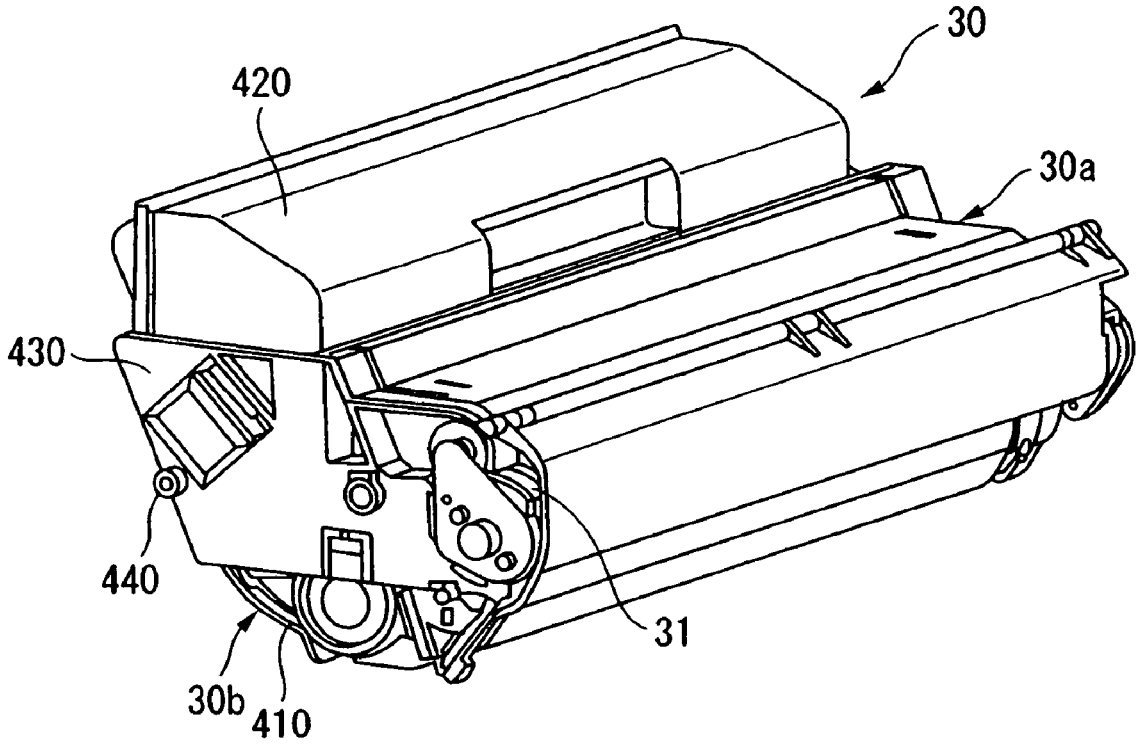
FIG. 14 is an explanatory view of an outer shape of the process cartridge shown in FIG. 13.
Figure 15:
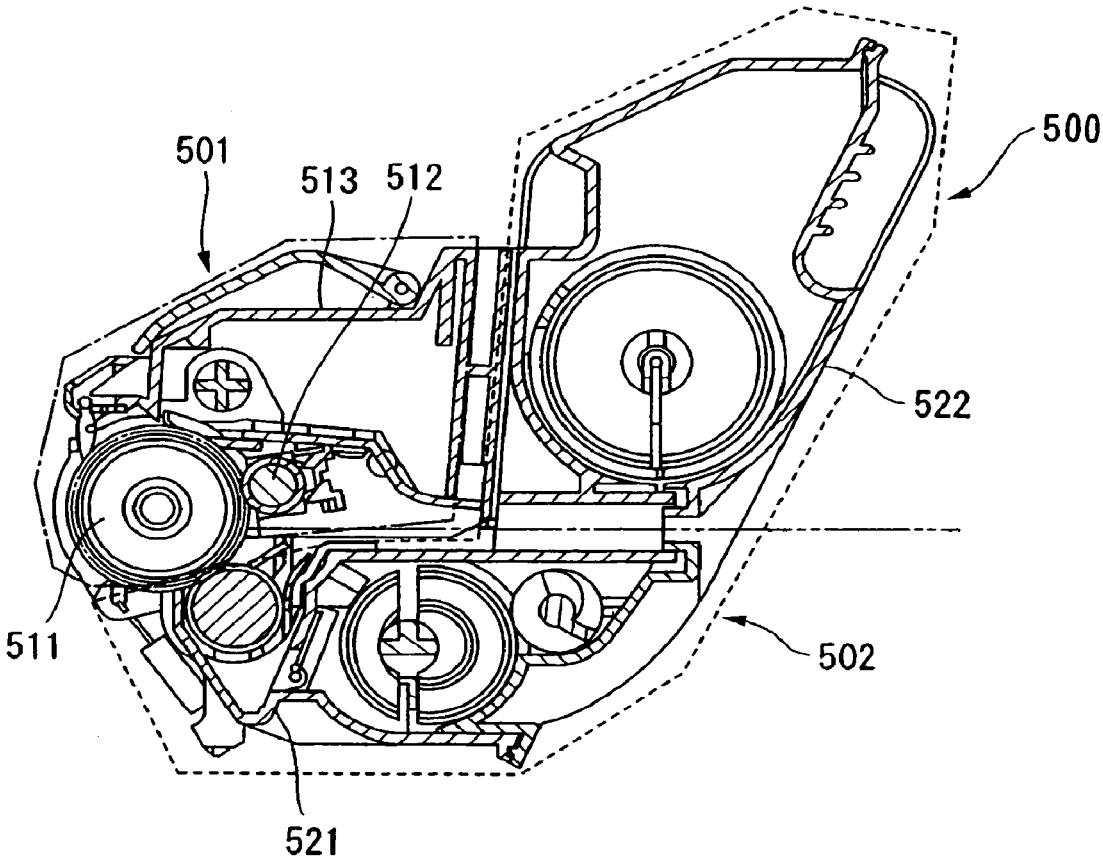
FIG. 15 PRIOR ART
FIG. 15 is an explanatory view showing an example of a process cartridge of a background art.

According to the embodiment, a large portion of a device of the image forming unit 22 is constituted by the process cartridge 30, as shown by FIG. 12 through FIG. 14, the process cartridge 30 is integrated with the photosensitive cartridge 30*a* and the developing cartridge 30*b*, in this example, by opening an opening/closing cover 90 provided at an upper portion of the apparatus cabinet 21, the process cartridge 30 is attachably and detachably mounted to the apparatus cabinet 21.

Further, according to the embodiment, the photosensitive cartridge 30*a* is supported by the developing cartridge 30*b* pivotably by a pin (not illustrated), and is urged to press in a predetermined direction by an urge spring, not illustrated. Further, similar to Embodiment 1, the scanning path 135 is ensured between the photosensitive cartridge 30*a* and the developing cartridge 30*b*.

Further, according to the embodiment, the photosensitive cartridge 30*a* is provided with the photosensitive drum 31, the charging unit (charging roll) 32 for charging the photosensitive drum 31, and the cleaning unit (cleaning apparatus) 34 for cleaning the photosensitive drum 31.

On the other hand, according to the embodiment, the developing cartridge 30*b* adopts, for example, one component developing system, and is provided with only a developing unit 400. The developing unit 400 includes a developing housing 401 opened opposedly to the photosensitive drum 31, a processing agent containing chamber 402 capable of containing a processing agent including a toner is formed in the developing housing 401, a developing roll 403 is arranged at an opening portion of the developing housing 401, a layer thickness restricting blade 404 for restricting a layer thickness of the processing agent is provided at a surrounding of the developing roll 403, further, an auxiliary agitator 405 for agitating the toner is provided on a rear side of the developing roll 403, an agitator 406 for carrying the replenishing toner to the developing roll 403 is arranged on a rear face side thereof, further, an agitator 407 for uniformly carrying the toner replenished to the developing housing 401 is arranged on a rear side thereof.

The developing unit 400 is connected to communicate with a toner replenishing unit 410 via a toner replenishing duct 420, according to the embodiment, the toner replenishing unit 410 is unitized as an element on a side of the photosensitive cartridge 30*a*. Inside of the toner replenishing unit 410 is provided with a toner agitator 411 for agitating the replenishing toner and carrying the replenishing toner to the toner replenishing duct 420. Further, the toner replenishing duct 420 is constituted by an elastic member.

Further, according to the embodiment, both ends of a support shaft of the photosensitive drum 31 of the photosensitive cartridge 30*a* are positioned and supported by a driving system and a bearing portion of a cartridge receive portion (constituted at a portion of the apparatus cabinet 21), not illustrated, and as shown by FIG. 14, support projections 440 are respectively provided on both sides of a cartridge case 430 remote from the photosensitive drum 31, and the support projections 440 are engaged with positioning portions of the cartridge receive portion, not illustrated.

According to the embodiment, the photosensitive cartridge 30*a* is positioned and fixed in the apparatus cabinet 21 and therefore, also the toner replenishing unit 410 integrated to the photosensitive cartridge 30*a* is positioned and fixed by the apparatus cabinet 21.

In this case, when the processing agent in the developing unit 400 of the developing cartridge 30*b* is consumed, the toner is replenished from the toner replenishing unit 410 in accordance with an amount of the consumed toner and therefore, the weight of the developing cartridge 30*b* is maintained substantially constant.

Therefore, even when the toner containing amount of the toner replenishing unit 410 is varied, the variation does not effect an influence on a change in the weight of the developing cartridge 30*b*.

Therefore, even when the toner containing amount of the toner replenishing unit 410 is varied, a variation in a force of urging to press the developing cartridge 30*b* to the photosensitive cartridge 30*a* is restrained until the toner replenishing unit 410 is emptied and a disturbance in an image can effectively be prevented by that amount.

What is claimed is:

1. A process cartridge provided attachably and detachably to and from an image forming apparatus main body, and including an image carrier, a developing unit for visualizing an electrostatic latent image on the image carrier by at least a toner and a toner replenishing unit for replenishing at least the toner to the developing unit, the process cartridge comprising:

an image carrier cartridge unitized by including at least the image carrier and positioned and supported by the image forming apparatus main body; and a developing cartridge unitized by including at least the developing unit and urged to press to the image carrier cartridge in a state of being positioned relative to the image carrier cartridge, wherein:

a first part of the toner replenishing unit is included in the image carrier cartridge;

a second part of the toner replenishing unit is included in the developing cartridge; and at least a portion of the toner replenishing unit is supported by the image forming apparatus main body.

2. A process cartridge provided attachably and detachably to and from an image forming apparatus main body, and including an image carrier, a developing unit for visualizing an electrostatic latent image on the image carrier by at least a toner and a toner replenishing unit for replenishing at least the toner to the developing unit, the process cartridge comprising:

an image carrier cartridge unitized by including at least a total or a portion of the image carrier and the toner replenishing unit and supported by the image forming apparatus main body; and a developing cartridge unitized by including at least the developing unit and urged to press to the image carrier cartridge in a state of being positioned relative to the image carrier cartridge.

3. The process cartridge according to claim 2, wherein the process cartridge includes a portion of the toner replenishing unit.

4. The process cartridge according to claim 2, wherein the toner replenishing unit is arranged separately to the image carrier cartridge and the developing cartridge.

5. The process cartridge according to claim 1, wherein the first part of the toner replenishing unit communicates with the second part of the toner replenishing unit by way of a deformable toner supply path.

6. The process cartridge according to claim 5, wherein the toner supply path is formed by being surrounded by an elastic member and the developing cartridge is urged to press by the elastic member.

7. The process cartridge according to claim 5, wherein a portion of the toner supply path connected to communicate with the toner replenishing unit or the developing unit is closed by an openable seal member when the portion is used.

8. The process cartridge according to claim 2, wherein the toner replenishing unit included in the image carrier cartridge includes a supporting portion supported by the image forming apparatus main body.

9. The process cartridge according to claim 8, wherein the supporting portion of the toner replenishing unit included in the image carrier cartridge is positioned in a direction different from an axial direction of the image carrier.

10. The process cartridge according to claim 8, wherein the supporting portion of the toner replenishing unit included in the image carrier cartridge is provided at a unit outer wall on a side of being remote from the image carrier.

11. The process cartridge according to claim 8, wherein a plurality of the supporting portions of the toner replenishing unit included in the image carrier cartridge are provided.

12. The process cartridge according to claim 1, wherein a latent image writing path is provided at a vicinity of at least a portion of the toner replenishing unit supported by the image forming apparatus main body.

13. The process cartridge according to claim 1, wherein a latent image lighting path is interposed between the image carrier cartridge and the developing cartridge.

14. An image forming apparatus comprising:

an image forming apparatus main body; and a process cartridge provided attachably and detachably to and from the image forming apparatus main body, and including an image carrier, a developing unit for visualizing an electrostatic latent image on the image carrier by at least a toner and a toner replenishing unit for replenishing at least the toner to the developing unit, the process cartridge including: an image carrier cartridge unitized by including at least the image carrier and positioned and supported by the image forming apparatus main body; and a developing cartridge unitized by including at least the developing unit and urged to press to the image carrier cartridge in a state of being positioned relative to the image carrier cartridge, wherein:

a first part of the toner replenishing unit is included in the image carrier cartridge;

a second part of toner replenishing unit is included in the developing cartridge; and at least a portion of the toner replenishing unit is supported by the image forming apparatus main body.

15. The image forming apparatus according to claim 14, wherein the first part of the toner replenishing unit communicates with the second part of the toner replenishing unit by way of a deformable toner supply path.

* * * * *